US008980019B2

(12) United States Patent
Ueda et al.

(10) Patent No.: US 8,980,019 B2
(45) Date of Patent: Mar. 17, 2015

(54) STEEL RAIL AND METHOD OF MANUFACTURING THE SAME

(75) Inventors: Masaharu Ueda, Tokyo (JP); Jun Takahashi, Tokyo (JP); Akira Kobayashi, Tokyo (JP); Takuya Tanahashi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 305 days.

(21) Appl. No.: 13/699,108

(22) PCT Filed: Jun. 7, 2011

(86) PCT No.: PCT/JP2011/063020

§ 371 (c)(1),
(2), (4) Date: Nov. 20, 2012

(87) PCT Pub. No.: WO2011/155481

PCT Pub. Date: Dec. 15, 2011

(65) Prior Publication Data

US 2013/0065079 A1 Mar. 14, 2013

(30) Foreign Application Priority Data

Jun. 7, 2010 (JP) ..... 2010-130164

(51) Int. Cl.
*C22C 38/52* (2006.01)
*C21D 9/04* (2006.01)

(Continued)

(52) U.S. Cl.
CPC . *C22C 38/54* (2013.01); *C21D 9/04* (2013.01); *C22C 38/02* (2013.01);

(Continued)

(58) Field of Classification Search
None
See application file for complete search history.

(56) References Cited

U.S. PATENT DOCUMENTS 5,762,723 A * 6/1998 Ueda et al. ..... 148/320
5,830,286 A * 11/1998 Ueda et al. ..... 148/330

(Continued)

FOREIGN PATENT DOCUMENTS

JP 07-173530 7/1995
JP 08-144016 6/1996

(Continued)

OTHER PUBLICATIONS

International Search Report dated Sep. 3, 2011, issued in corresponding PCT Application No. PCT/JP2011/063020.

(Continued)

*Primary Examiner* — Deborah Yee
(74) *Attorney, Agent, or Firm* — Kenyon & Kenyon LLP

(57) ABSTRACT

A steel rail includes: by mass %, higher than 0.85% to 1.20% of C; 0.05% to 2.00% of Si; 0.05% to 0.50% of Mn; 0.05% to 0.60% of Cr; P≤0.0150%; and the balance consisting of Fe and inevitable impurities, wherein 97% or more of a head surface portion which is in a range from a surface of a head corner portion and a head top portion as a starting point to a depth of 10 mm has a pearlite structure, a Vickers hardness of the pearlite structure is Hv320 to 500, and a CMn/FMn value which is a value obtained by dividing CMn [at. %] that is a Mn concentration of a cementite phase in the pearlite structure by FMn [at. %] that is a Mn concentration of a ferrite phase is equal to or higher than 1.0 and equal to or less than 5.0.

3 Claims, 8 Drawing Sheets

(51) Int. Cl.

| | |
|---|---|
| ***C22C 38/54*** | (2006.01) |
| ***C22C 38/02*** | (2006.01) |
| ***C22C 38/04*** | (2006.01) |
| ***C22C 38/18*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *B21B 1/085* | (2006.01) |

(52) U.S. Cl.

CPC ..... *C22C 38/04* (2013.01); *C22C 38/18* (2013.01); *C22C 38/42* (2013.01); *C22C 38/44* (2013.01); *C22C 38/46* (2013.01);*C22C 38/48* (2013.01); *C22C 38/50* (2013.01); *C22C 38/52* (2013.01); *B21B 1/085* (2013.01); *C21D 2211/003* (2013.01); *C21D 2211/005* (2013.01); *C21D 2211/009* (2013.01)

USPC ..... 148/333; 148/581; 148/584; 148/654; 148/320; 148/334; 148/335

(56) References Cited

U.S. PATENT DOCUMENTS

| | | | | |
|---|---|---|---|---|
| 2004/0187981 | A1* | 9/2004 | Ueda et al. | 148/584 |
| 2008/0011393 | A1* | 1/2008 | Ueda et al. | 148/584 |

FOREIGN PATENT DOCUMENTS

| | | |
|---|---|---|
| JP | 08-246100 | 9/1996 |
| JP | 09-316598 | 12/1997 |
| JP | 2001-234238 | 8/2001 |
| JP | 2002-226915 | 8/2002 |
| JP | 2003-129182 | 5/2003 |
| JP | 2005-146346 | 6/2005 |
| JP | 2005-171327 | 6/2005 |
| JP | 2010-077481 | 4/2010 |
| RU | 2107740 | 3/1998 |
| RU | 2112051 | 5/1998 |
| RU | 2139946 | 10/1999 |

OTHER PUBLICATIONS

Notice of Allowance dated Jan. 29, 2014 issued in corresponding Russian Application No. RU 2012151518 [with English Translation].

* cited by examiner

STEEL RAIL AND METHOD OF MANUFACTURING THE SAME

TECHNICAL FIELD

This application is a national stage application of International Application No. PCT/JP2011/063020, filed Jun. 7, 2011, which claims priority to Japanese Patent Application No. 2010-130164, filed on Jun. 7, 2010, the content of which is incorporated herein by reference.

Priority is claimed on Japanese Patent Application No. 2010-130164, filed on Jun. 7, 2010, the content of which is incorporated herein by reference.

BACKGROUND ART

With economic development, terrain in rugged natural environments that have hitherto not been developed is being mined for natural resources such as coal. Therefore, the track environment of a freight railway for transport of resources has become significantly harsher, and thus there is demand of the rail for wear resistance, and toughness in cold regions, and the like at least as high as currently available. From this background, there is demand for the development of a rail having wear resistance and high toughness at least as high as the high-strength rail that is currently used.

In order to improve the wear resistance of rail steel, rails as described below were developed. The main characteristics of such rails are that in order to enhance wear resistance, the carbon content in steel was increased, the volume ratio of a cementite phase in pearlite lamellae was increased, and moreover hardness was controlled (for example, refer to Patent Documents 1 and 2).

In the technique disclosed in Patent Document 1, using hypereutectoid steel (with higher than 0.85% to 1.20% of C), the volume ratio of cementite in the lamellae in a pearlite structure is increased, thereby providing a rail having excellent wear resistance.

In addition, in the technique disclosed in Patent Document 2, using hypereutectoid steel (with higher than 0.85% to 1.20% of C), the volume ratio of cementite in the lamellae in a pearlite structure is increased, and simultaneously, hardness is controlled, thereby providing a rail having excellent wear resistance.

In the techniques disclosed in Patent Documents 1 and 2, the volume ratio of the cementite phase in the pearlite structure is increased by increasing the carbon content in steel, and thus an increase in wear resistance to a certain level is achieved. However, in such cases, the toughness of the pearlite structure itself is significantly degraded, and thus there is a problem in that rail breakage is likely to occur.

From this background, it was desired to provide a steel rail having excellent wear resistance and toughness obtained by enhancing the wear resistance of a pearlite structure and simultaneously enhancing toughness.

In general, in order to increase the toughness of pearlite steel, it is said that refinement (increasing the fineness) of a pearlite structure, specifically, refinement of the grains of an austenite structure before pearlite transformation or refinement of a pearlite block size is effective. In order to achieve the fine-grained austenite structure, a reduction in rolling temperature and an increase in rolling reduction during hot rolling, and moreover, heat treatment by low-temperature reheating after rail rolling, are performed. In addition, in order to achieve the fine pearlite structure, acceleration of pearlite transformation from the inside of austenite grains using transformation nuclei, or the like is performed.

However, in the manufacture of rails, from the viewpoint of ensuring formability during hot rolling, there are limitations on the reduction in rolling temperature and the increase in rolling reduction, and thus sufficiently refinement of the austenite grains is difficult to achieve. In addition, regarding the pearlite transformation from the inside of the austenite grains using the transformation nuclei, there are problems in that controlling the amount of transformation nuclei is difficult, the pearlite transformation from the inside of the grains is not stabilized, and the like, preventing a sufficiently fine pearlite structure from being achieved.

From these problems, in order to fundamentally improve the toughness of a rail having a pearlite structure, a method of performing low-temperature reheating after rail rolling, and thereafter causing pearlite transformation through accelerated cooling, thereby refinement of the pearlite structure has been used. However, in recent years, there has been a progressive increase in the carbon content in rails in order to improve wear resistance. In this case, there is a problem in that coarse carbides remain dissolved in austenite grains during the low-temperature reheating heat treatment, and thus the ductility or toughness of the pearlite structure is degraded after the accelerated cooling. In addition, since the reheating is performed, there are economic problems such as high manufacturing cost and low productivity.

Here, there is demand for the development of a method of manufacturing a high-carbon steel rail by ensuring formability during hot rolling and refinement of a pearlite structure after the hot rolling. In order to solve the problems, methods of manufacturing a high-carbon steel rail as described below have been developed. The main characteristics of such rails are that in order to increase the fineness of a pearlite structure, a property of austenite grains of high-carbon steel being more likely to recrystallize at a relatively low temperature and at a small rolling reduction amount is used. Accordingly, well-ordered fine grains are obtained by continuous rolling with a small rolling reduction, thereby enhancing the ductility or toughness of pearlite steel (for example, refer to Patent Documents 3, 4, and 5).

In the technique disclosed in Patent Document 3, in finish rolling of a steel rail having high-carbon steel, three or more continuous passes of hot rolling are performed between predetermined interval time of rolling passes, thereby providing a high-ductility and high-toughness rail.

In addition, in the technique disclosed in Patent Document 4, in finish rolling of a steel rail having high-carbon steel, two or more continuous passes of rolling are performed between predetermined interval time of hot rolling passes, and moreover, after performing continuous rolling, accelerated cooling is performed after the hot rolling, thereby providing a high-wear-resistance and high-toughness rail.

Moreover, in the technique disclosed in Patent Document 5, in finish rolling of a steel rail having high-carbon steel, cooling is performed between hot rolling passes, and after performing continuous rolling, accelerated cooling is performed after the hot rolling, thereby providing a high-wear-resistance and high-toughness rail.

In the techniques disclosed in Patent Documents 3 to 5, by the temperature during continuous hot rolling, and a combination of the number of rolling passes and time between passes, refinement of the austenite structure to a certain level is achieved, and thus a slight increase in toughness is acknowledged. However, the effect is not acknowledged regarding fractures that occur from inclusions existing in steel as origins or fractures that occur from a pearlite structure as an origin other than from inclusions as origins, and toughness is not fundamentally enhanced.

CITATION LIST

Patent Literature

[Patent Document 1] Japanese Unexamined Patent Application, First Publication No. H8-144016
[Patent Document 2] Japanese Unexamined Patent Application, First Publication No. H8-246100
[Patent Document 3] Japanese Unexamined Patent Application, First Publication No. H7-173530
[Patent Document 4] Japanese Unexamined Patent Application, First Publication No. 2001-234238
[Patent Document 5] Japanese Unexamined Patent Application, First Publication No. 2002-226915

SUMMARY OF INVENTION

Technical Problem

The present invention has been made taking the foregoing circumstances into consideration, and an object thereof is to provide a steel rail having a head portion with simultaneously enhanced wear resistance and toughness, required of a rail for a freight railway in a rugged track environment.

Solution to Problem

In order to accomplish the object to solve the problem, the present invention employs the following measures.

(1) That is, according to an aspect of the present invention, there is provided a steel rail including: by mass %, higher than 0.85% to 1.20% of C; 0.05% to 2.00% of Si; 0.05% to 0.50% of Mn; 0.05% to 0.60% of Cr; P≤0.0150%; and the balance consisting of Fe and inevitable impurities, wherein 97% or more of a head surface portion which is in a range from a surface of a head corner portion and a head top portion as a starting point to a depth of 10 mm has a pearlite structure, a Vickers hardness of the pearlite structure is Hv320 to 500, and a CMn/FMn value which is a value obtained by dividing CMn [at. %] that is a Mn concentration of a cementite phase in the pearlite structure by FMn [at. %] that is a Mn concentration of a ferrite phase is equal to or higher than 1.0 and equal to or less than 5.0.

Here, Hv represents a Vickers hardness specified in JIS Z2244. In addition, at. % represents an atomic composition percentage.

(2) In the aspect described in (1), further included are one kind or two or more kinds selected from the group: by mass %, 0.01% to 0.50% of Mo; 0.005% to 0.50% of V; 0.001% to 0.050% of Nb; 0.01% to 1.00% of Co; 0.0001% to 0.0050% of B; 0.01% to 1.00% of Cu; 0.01% to 1.00% of Ni; 0.0050% to 0.0500% of Ti; 0.0005% to 0.0200% of Mg; 0.0005% to 0.0200% of Ca; 0.0001% to 0.0100% of Zr; 0.0040% to 1.00% of Al; and 0.0050% to 0.0200% of N.

(3) According to another aspect of the present invention, there is a method of manufacturing a steel rail which is a method of manufacturing the steel rail described in (1) or (2). The method may employ a configuration including: performing first accelerated cooling on a head portion of the steel rail at a temperature of equal to or higher than an Ar1 point immediately after hot rolling, or a head portion of the steel rail reheated to a temperature of equal to or higher than the Ac1 point+30° C. for purposes of a heat treatment, at a cooling rate of 4 to 15° C./sec from a temperature range of equal to or higher than 750° C.; stopping the first accelerated cooling at a time point when a temperature of the head portion of the steel rail reaches 600° C. to 450° C.; controlling a maximum temperature increase amount including transformation heat and recuperative heat to be equal to or less than 50° C. from an accelerated cooling stop temperature; thereafter performing second accelerated cooling at a cooling rate of 0.5 to 2.0° C./sec; and stopping the second accelerated cooling at a time point when the temperature of the head portion of the steel rail reaches 400° C. or less.

Advantageous Effects of Invention

According to the aspects described in (1) to (3), by controlling the structure, hardness, and moreover CMn/FMn value of the head portion of the steel rail that has a high-carbon pearlite structure to be in predetermined ranges, it is possible to simultaneously enhance the wear resistance and toughness of the rail for a freight railway.

DESCRIPTION OF EMBODIMENTS

Hereinafter, a steel rail having excellent wear resistance and toughness according to an embodiment of the present invention will be described in detail. Here, the present invention is not limited to the following description and it will be easily understood by those skilled in the art that the shapes and details thereof can be modified in various forms without departing from the spirit and scope of the present invention. Therefore, the present invention is not construed as being limited by the contents of embodiments described as follows. Hereinafter, mass % that represents composition is simply described as %.

First, the inventors had examined a component system of steel that had an adverse effect on the toughness of a rail. Using steels in which steel having a carbon content of 1.00% C was contained as the base and the P content was changed, hot rolling and heat treatment experiments were carried out under simulated hot rolling conditions corresponding to a rail. In addition, the effect of the P content on an impact value was examined by performing an impact test.

As a result, it was confirmed that when the P content in a rail steel having a pearlite structure with a hardness of Hv320 to 500 is reduced to 0.0150% or less, an impact value is increased.

Next, the inventors clarified the factors that control impact values in order to further increase the impact value of a rail, that is, to enhance toughness. In order to investigate the origin of a fracture in a rail steel having a pearlite structure in which a layered structure is composed of a ferrite phase and a cementite phase, specimens subjected to the Charpy impact test were observed in detail. As a result, in many cases, inclusions and the like were not acknowledged at the origin portions of the fracture, and the origin was the pearlite structure.

Moreover, the inventors had investigated the pearlite structure that becomes the origin of the fracture in detail. As a result, it was confirmed that cracking occurs in the cementite phase in the pearlite structure of the origin.

Here, the inventors had investigated the relationship between the occurrence of cracking of the cementite phase and components. Steels having a pearlite structure which contains as the base steel that has a P content of equal to or less than 0.0150% and a carbon content of 1.00% and which changes with the content of Mn added, were melted for testing, and test rolling under simulated hot rolling conditions corresponding to the manufacture of rails and heat treatment experiments were carried out. In addition, the effect of the Mn addition on an impact value was examined by performing an impact test.

Figure 1:
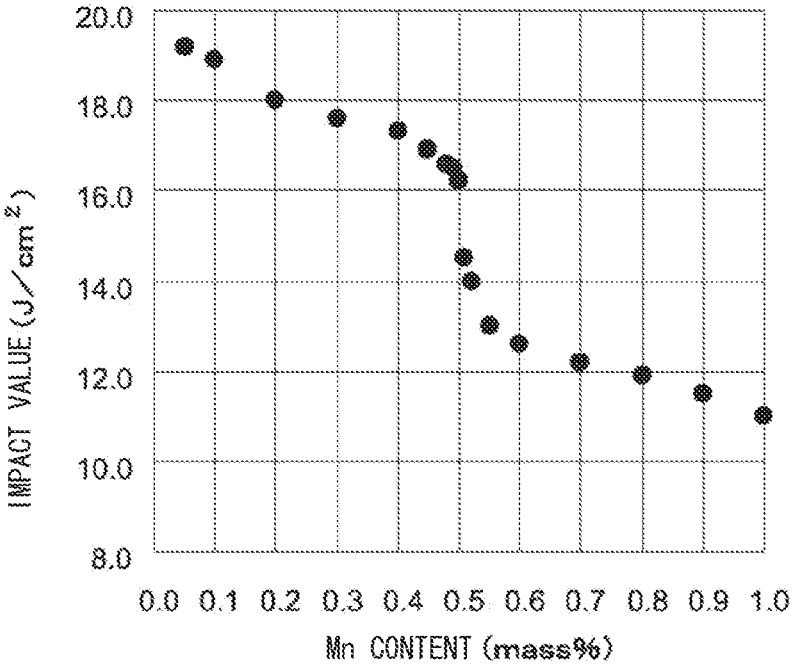
FIG. 1 is a graph showing the relationship between Mn addition and impact value in pearlite steel having a carbon content of 1.00%.

FIG. 1 is a graph showing the relationship between Mn addition and impact value. It was confirmed that when the Mn addition was reduced, an impact value was increased, and when the Mn addition was equal to or less than 0.50%, an impact value was significantly increased. Moreover, as a result of observing the pearlite structure at the origin portion, it was confirmed that when the Mn addition is equal to or less than 0.50%, the number of cracks in the cementite phase was reduced.

Next, the inventors had investigated the Mn content in the ferrite phase and the cementite phase in the pearlite structure. As a result, it was confirmed that when the Mn addition in the pearlite structure was reduced, the Mn content in the cementite phase was particularly reduced.

From these results, it became apparent that the toughness of the pearlite structure had a correlation with the Mn addition, and when the Mn addition was reduced, the Mn content in the cementite phase was reduced, cracking in the cementite phase at the origin portion was suppressed, and consequently the toughness of the pearlite structure was enhanced.

Mn in the pearlite structure dissolves as a solid solution in the cementite and ferrite phases. When the Mn concentration of the cementite phase that becomes an origin of a fracture is suppressed, the Mn concentration of the ferrite phase is increased. Here, the inventors had basically investigated the relationship between the balance of the Mn concentrations of both the phases and toughness in a case where the Mn addition was reduced.

Steels having a pearlite structure which has a P content of equal to or less than 0.0150%, an Mn addition of 0.30%, and a carbon content of 1.00% were produced as ingots in a laboratory, and test rolling under simulated hot rolling conditions corresponding to the manufacture of rails and heat treatment experiments under various conditions were carried out. In addition, by performing investigation of the Mn content in the ferrite phase and the cementite phase and an impact test, the relationship between impact value and the Mn content in the ferrite phase and the cementite phase was investigated.

Figure 2:
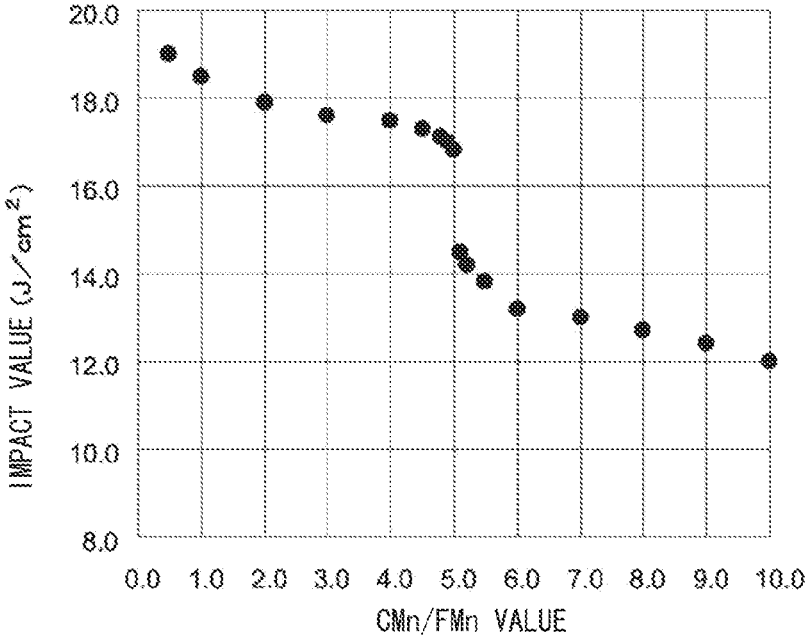
FIG. 2 is a graph showing the relationship between CMn/FMn value and impact value in the pearlite steel having a carbon content of 1.00%.

FIG. 2 shows the relationship between CMn/FMn value and impact value. It was confirmed that in a case of pearlite structures having the same Mn addition, when the CMn/FMn value was reduced, an impact value was increased, and when the CMn/FMn value was equal to or less than 5.0, an impact value was significantly increased.

From the result, it became apparent that by controlling the Mn addition of the pearlite structure to be equal to or less than 0.50% and controlling the CMn/FMn value to be equal to or less than 5.0, cracking in the cementite phase at the origin where an impact was exerted was significantly reduced, and as a result, the toughness of the pearlite structure was enhanced.

Moreover, the inventors had examined a method of controlling the CMn/FMn value in a case where the Mn addition of the pearlite structure was controlled to be equal to or less than 0.50%. Steel having a pearlite structure in which a P content was equal to or less than 0.0150%, an Mn addition of 0.30%, and a carbon content of 1.00% was produced as ingots in a laboratory, and test rolling as simulated hot rolling for rails and heat treatment experiments under various conditions were carried out. In addition, the effect of heat treatment conditions on the relationship between CMn/FMn value and impact value were investigated by performing investigation of CMn/FMn values and an impact test.

FIG. 3(A) is a graph showing the relationship between accelerated cooling rate after hot rolling or after reheating and CMn/FMn value.

FIG. 3(B) is a graph showing the relationship between accelerated cooling rate after hot rolling or after reheating and impact value.

FIG. 4(A) is a graph showing the relationship between maximum temperature increase amount after accelerated cooling and CMn/FMn value.

FIG. 4(B) is a graph showing the relationship between maximum temperature increase amount after accelerated cooling and impact value.

FIG. 5(A) is a graph showing the relationship between accelerated cooling rate after a temperature increase and CMn/FMn value.

FIG. 5(B) is a graph showing the relationship between accelerated cooling rate after a temperature increase and impact value.

Figure 3:
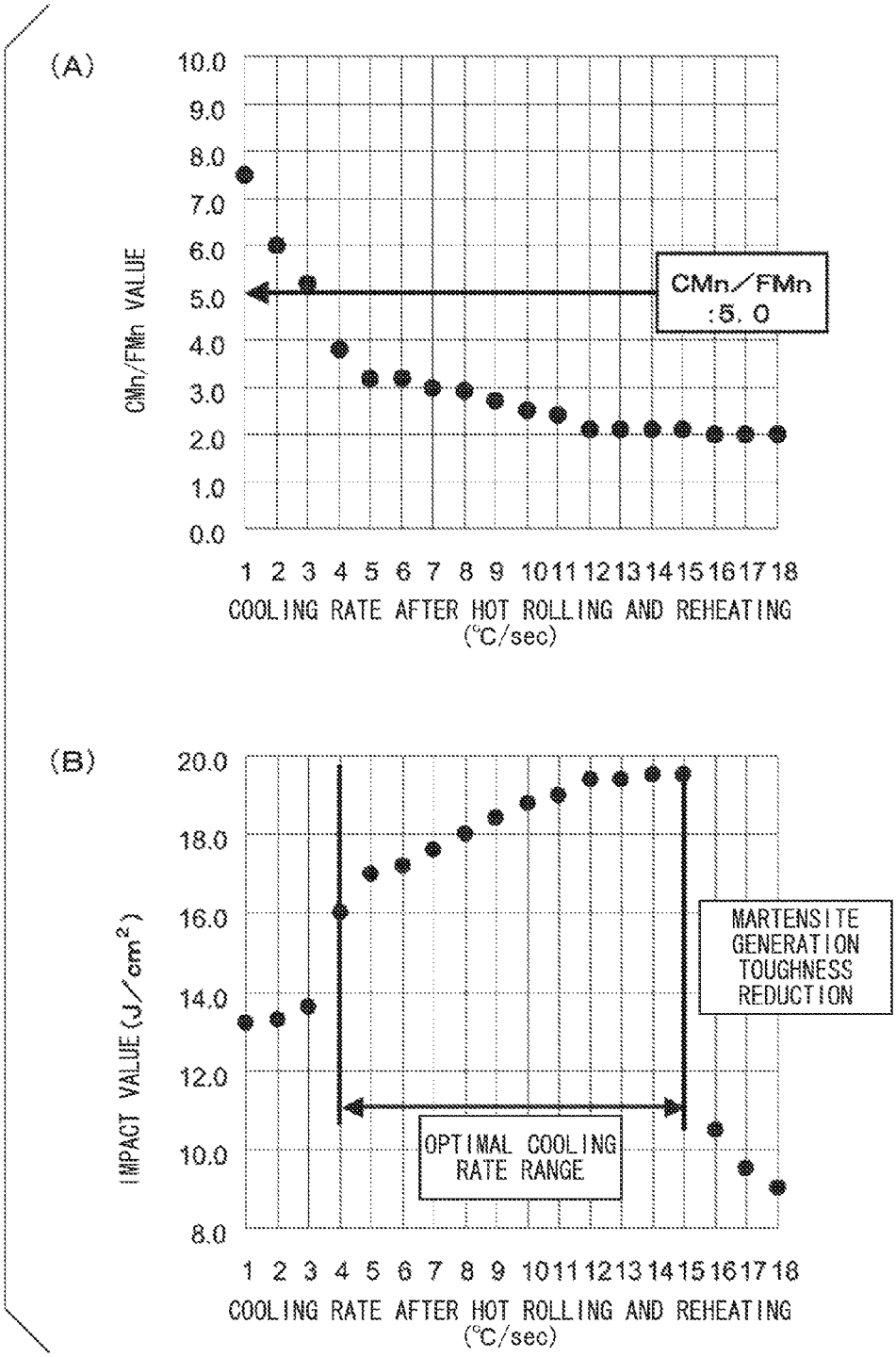
FIG. 3(A) is a graph showing the relationship between accelerated cooling rate (cooling rate of first accelerated cooling) after hot rolling or after reheating of the pearlite steel having a carbon content of 1.00% and CMn/FMn value.
FIG. 3(B) is a graph showing the relationship between accelerated cooling rate after hot rolling or after reheating of the pearlite steel having a carbon content of 1.00% and impact value.
Figure 4:
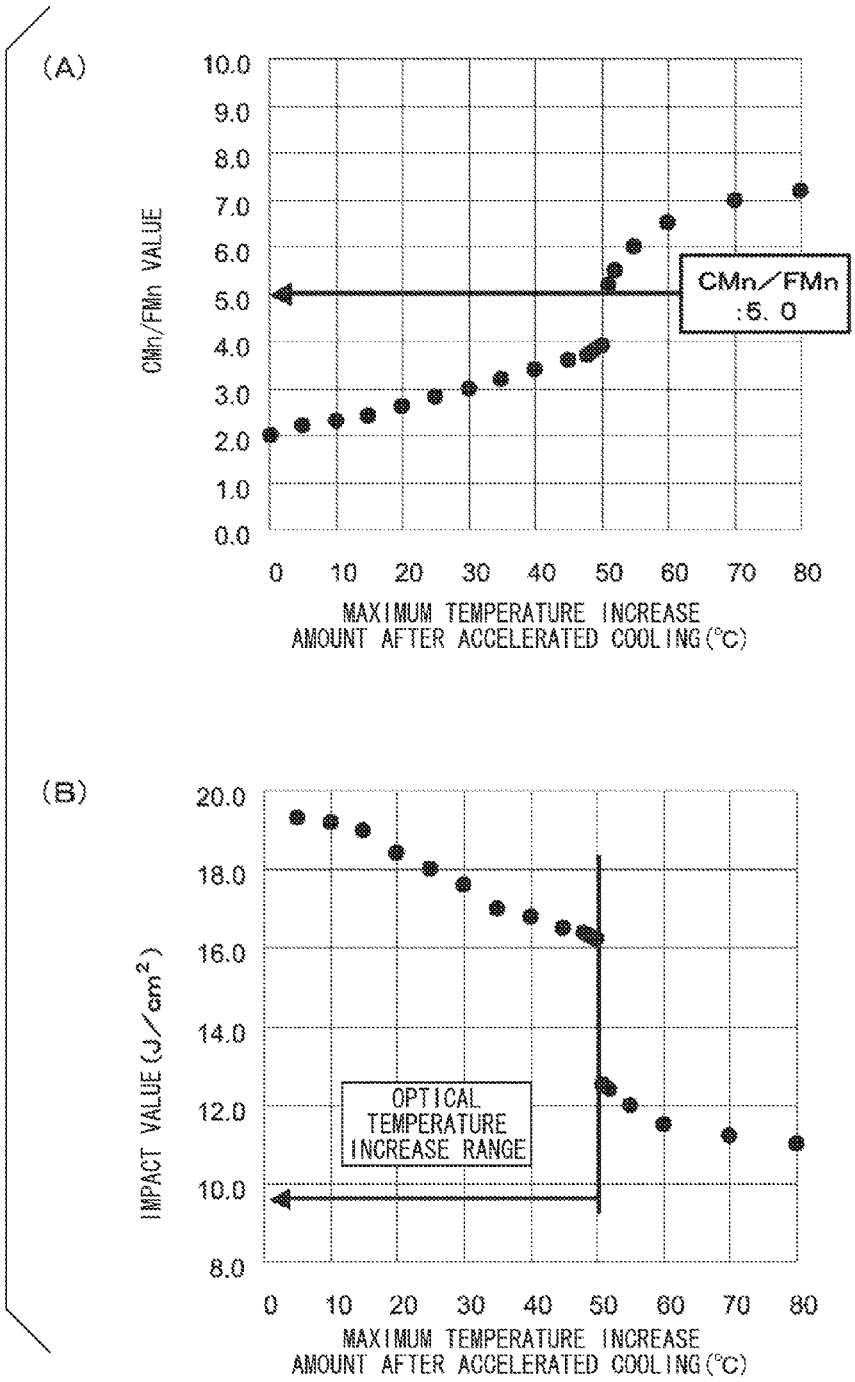
FIG. 4(A) is a graph showing the relationship between maximum temperature increase amount after accelerated cooling after hot rolling or after reheating of the pearlite steel having a carbon content of 1.00% and CMn/FMn value.
FIG. 4(B) is a graph showing the relationship between maximum temperature increase amount after accelerated cooling after hot rolling or after reheating of the pearlite steel having a carbon content of 1.00% and impact value.
Figure 5:
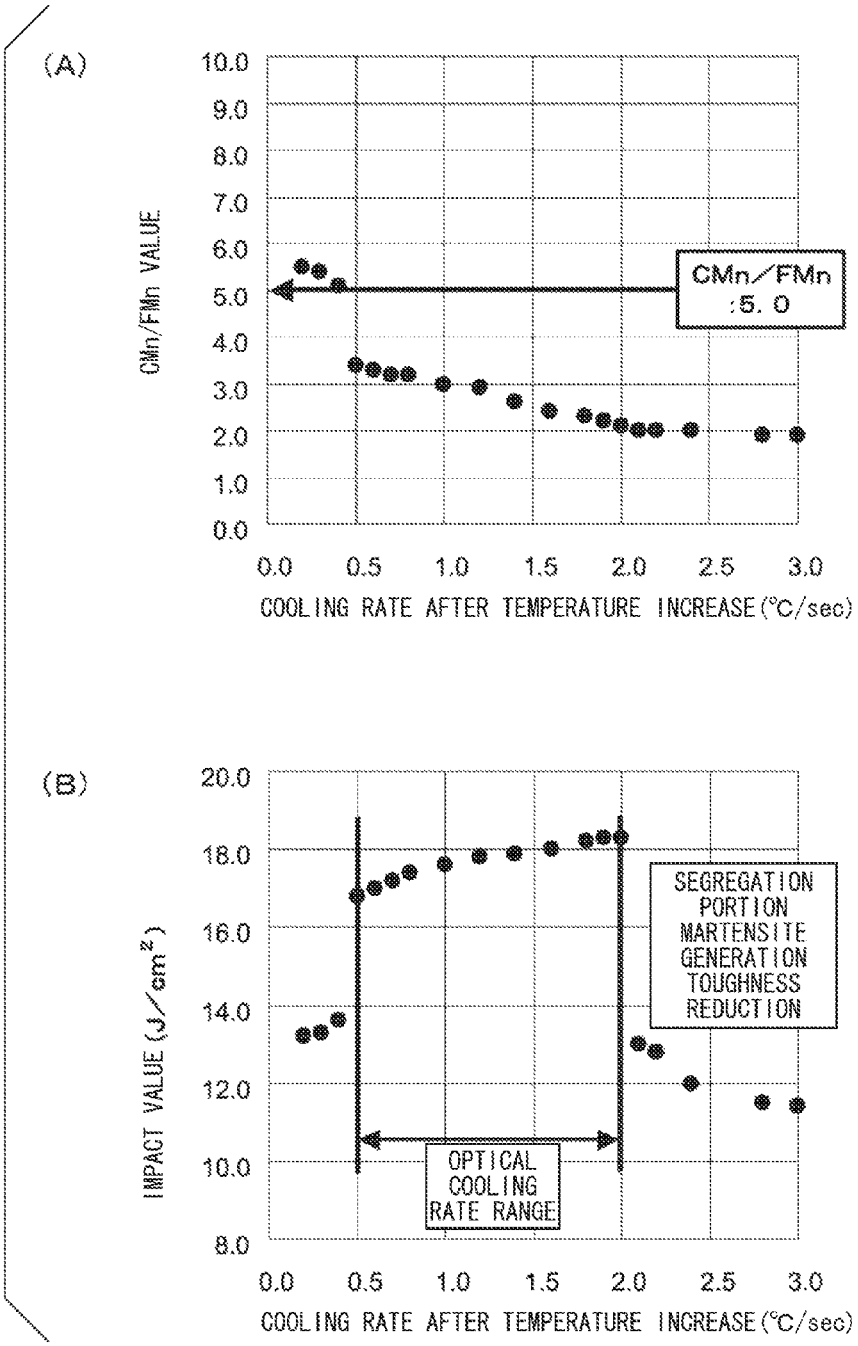
FIG. 5(A) is a graph showing the relationship between accelerated cooling rate (cooling rate of second accelerated cooling) after a temperature increase of the pearlite steel having a carbon content of 1.00% and CMn/FMn value.
FIG. 5(B) is a graph showing the relationship between accelerated cooling rate after a temperature increase of the pearlite steel having a carbon content of 1.00% and impact value.

In addition, manufacturing conditions of the base of rail steels shown in FIGS. 3 to 5 are as follows, and regarding the base manufacturing conditions, manufacturing was performed by changing only the conditions to be evaluated.

[Cooling Conditions after Hot Rolling and Reheating]

Cooling start temperature: 800° C., cooling rate: 7° C./sec,

Cooling stop temperature: 500° C., maximum temperature increase amount: 30° C.

[Cooling Conditions after Temperature Increase]

Cooling start temperature: 530° C., cooling rate: 1.0° C./sec,

Cooling stop temperature: 350° C.

For example, regarding the relationship between accelerated cooling rate after hot rolling or after reheating and CMn/FMn value shown in FIG. 3, manufacturing in a condition in which only the accelerated cooling rate after hot rolling or after reheating was changed under the base manufacturing conditions was cited.

As a result, it became apparent that the CMn/FMn value was significantly changed by (1) an accelerated cooling rate after hot rolling or after reheating, (2) the maximum temperature increase amount after accelerated cooling, and (3) an accelerated cooling rate after a temperature increase. In addition, it was found that by controlling the cooling rate and the temperature increase amount in constant ranges, an increase in the concentration of Mn in the cementite phase was suppressed, the CMn/FMn value was reduced, and cracking in the cementite phase in the pearlite structure at the origin portion was consequently suppressed, resulting in a significant increase in impact value.

That is, according to this embodiment, by controlling the structure, hardness, Mn addition, and CMn/FMn value of the head portion of a steel rail that has a high-carbon pearlite structure to be in constant ranges and by performing appropriate heat treatments on the rail head portion, it is possible to simultaneously enhance the wear resistance and toughness of the rail for a freight railway.

Next, the reason for limitation in the present invention will be described in detail.

(1) Reason for Limitation of Chemical Components of Steel

The reason that the chemical components of steel in the steel rail of this embodiment are limited to the above-described numerical ranges will be described in detail.

C is an element effective in accelerating pearlite transformation and ensuring wear resistance. When the C content is less than 0.85%, minimum strength or wear resistance required of a rail may not be maintained in this component system. In addition, when the C content exceeds 1.20%, a large amount of coarse pro-eutectoid cementite structure is generated, and thus wear resistance or toughness is degraded. Therefore, a C addition is limited to higher than 0.85% to 1.20%. In addition, in order to enhance wear resistance and toughness, it is more preferable that the C content be 0.90% to 1.10%.

Si is an essential component as a deoxidizing material. In addition, Si increases the hardness (strength) of the rail head portion through solid solution strengthening in the ferrite phase in the pearlite structure, and thus enhances wear resistance. Moreover, Si is an element that suppresses the generation of a pro-eutectoid cementite structure in hypereutectoid steel and thus suppresses the degradation of toughness. However, when the Si content is less than 0.05%, those effects may not be sufficiently expected. In addition, when the Si content exceeds 2.00%, many surface defects are generated during hot rolling or oxides are generated, resulting in the degradation of weldability. Moreover, hardenability significantly increases, and thus a martensite structure which is harmful to the wear resistance or toughness of the rail is more likely to be generated. Therefore, the Si addition is limited to 0.05% to 2.00%. In addition, in order to increase the hardness (strength) of the rail head portion and suppress the generation of the martensite structure which is harmful to wear resistance or toughness, it is more preferable that the Si content be 0.10% to 1.30%.

Mn is an element that increases hardenability and thus increases the fineness of a pearlite lamellar spacing, thereby ensuring the hardness of the pearlite structure and enhancing wear resistance. However, when the Mn content is less than 0.05%, those effects are small, and it is difficult to ensure wear resistance that is needed for the rail. In addition, when the Mn content exceeds 0.50%, the Mn concentration of the cementite phase in the pearlite structure is increased, cracking in the cementite phase of the fracture origin portion is exacerbated, resulting in a significant degradation in the toughness of the pearlite structure. Therefore, the Mn addition is limited to 0.05% to 0.50%. In addition, in order to suppress cracking in the cementite phase and the hardness of the pearlite structure, it is more preferable that the Mn content be 0.10% to 0.45%.

Cr is an element that increases an equilibrium transformation temperature and consequently increases the fineness of the lamellar spacing of the pearlite structure, thereby contributing to an increase in hardness (strength). Simultaneously, Cr strengthens a cementite phase and thus enhances the hardness (strength) of the pearlite structure, thereby enhancing the wear resistance of the pearlite structure. However, when the Cr content is less than 0.05%, those effects are small, and an effect of enhancing the hardness of the rail steel may not be completely exhibited. In addition, when an excessive addition is performed to cause the Cr content to be higher than 0.60%, a bainite structure which is harmful to the wear resistance of the rail is more likely to be generated. In addition, hardenability is increased, and thus the martensite structure which is harmful to the wear resistance or toughness of the rail is more likely to be generated. Therefore, the Cr addition is limited to 0.05% to 0.60%. In addition, in order to enhance the hardness of the rail steel and suppress the generation of the bainite structure or the martensite structure which is harmful to wear resistance or toughness, it is more preferable that the Cr content be 0.10% to 0.40%.

P is an element that is inevitably contained in steel. There is a correlation between the P content and toughness. When the P content is increased, the pearlite structure becomes embrittled due to the embrittlement of the ferrite phase, and thus brittle fracture, that is, rail damage is more likely to occur. Therefore, in order to enhance toughness, it is preferable that the P content be low. As a result of checking the correlation between impact value and P content in a laboratory, it was confirmed that when the P content was reduced to 0.0150% or less, the embrittlement of the ferrite phase which was the origin of a fracture was suppressed, and thus an impact value was significantly enhanced. From this result, the P content is limited to be equal to or less than 0.0150%. In addition, the lower limit of the P content is not limited. However, in consideration of dephosphorizing performance in a refining process, it is thought that about 0.0020% is the limit of the P content during actual manufacturing.

In addition, a treatment of reducing the P content not only causes an increase in refining cost but also degrades productivity. Here, in consideration of economic efficiency and in order to stably increase the impact value, it is preferable that the P content be 0.0030% to 0.0100%.

In addition, to the rail manufactured of the component composition described above, elements Mo, V, Nb, Co, B, Cu, Ni, Ti, Ca, Mg, Zr, Al, and N may be added as necessary for purposes of enhancing the hardness (strength) of the pearlite structure, that is, enhancing wear resistance, furthermore, enhancing toughness, preventing a welding heat-affected zone from softening, and controlling a cross-sectional hardness distribution of the inside of the rail head portion.

Here, Mo increases the equilibrium transformation point of pearlite and mainly increases the fineness of the pearlite lamellar spacing, thereby enhancing the hardness of the pearlite structure. V and Nb suppress the growth of austenite grains by carbides and nitrides generated during hot rolling and a cooling process thereafter, and enhance the toughness and hardness of the pearlite structure by precipitation hardening. In addition, V and Nb stably generate carbides and nitrides during reheating and thus prevent a heat-affected zone of a welding joint from softening. Co increases the fineness of the lamellar structure or ferrite grain size of a wearing surface, thereby increasing the wear resistance of the pearlite structure. B reduces the cooling rate dependence of a pearlite transformation temperature, thereby uniformizing the hardness distribution of the rail head portion. Cu dissolves as a solid solution into ferrite in the ferrite structure or the pearlite structure, thereby increasing the hardness of the pearlite structure. Ni enhances the toughness and hardness of the ferrite structure or the pearlite structure and simultaneously prevents the heat-affected zone of the welding joint from softening. Ti increases the fineness of the structure of the heat-affected zone and thus prevents the embrittlement of the welding joint portion. Ca and Mg increase the fineness of the austenite grains during rail rolling and simultaneously accelerate pearlite transformation, thereby enhancing the toughness of the pearlite structure. Zr increases the equiaxial crystallization rate of a solidified structure and suppresses the formation of a segregation zone of the center portion of a slab or bloom, thereby reducing the thickness of the pro-eutectoid cementite structure and enhancing the toughness of the pearlite structure. Al moves a eutectoid transformation temperature to a higher temperature side and thus increases the hardness of the pearlite structure. N accelerates pearlite transformation due to segregation at austenite grain boundaries and increases the fineness of a pearlite block size, thereby enhancing toughness. The effects of each of the elements are described above and are the main purpose of addition.

The reason for the limitation of such components will now be described in detail.

Mo is an element that increases the equilibrium transformation temperature like Cr and consequently increases the fineness of the lamellar spacing of the pearlite structure, thereby increasing the hardness of the pearlite structure and enhancing the wear resistance of the rail. However, when a Mo content is less than 0.01%, those effects are small, and an effect of enhancing the hardness of the rail steel is not exhibited at all. In addition, when an excessive addition is performed to cause a Mo content to be higher than 0.50%, a transformation rate is significantly reduced, and thus the bainite structure which is harmful to the wear resistance of the rail is more likely to be generated. In addition, the martensite structure which is harmful to the toughness of the rail is generated in the pearlite structure. Therefore, a Mo addition is limited to 0.01% to 0.50%.

V is an element that precipitates as V carbides or V nitrides during typical hot rolling or heat treatment performed at a high temperature and increases the fineness of austenite grains due to a pinning effect, thereby enhancing the toughness of the pearlite structure. Moreover, V is an element that increases the hardness (strength) of the pearlite structure through precipitation hardening by the V carbides and V nitrides generated during the cooling process after the hot rolling, thereby enhancing the wear resistance of the pearlite structure. In addition, V is an element that generates V carbides or V nitrides in a relatively high temperature range in a heat-affected zone that is reheated in a temperature range of equal to or less than an Ac1 point, and is thus effective in preventing the heat-affected zone of the welding joint from softening. However, when a V content is less than 0.005%, those effects may not be sufficiently expected, and the enhancement of the pearlite structure in the toughness or hardness (strength) is not acknowledged. In addition, when a V content exceeds 0.50%, the precipitation hardening of V carbides or V nitrides excessively occurs, and thus the pearlite structure becomes embrittled, thereby degrading the toughness of the rail. Accordingly, a V addition is limited to 0.005% to 0.50%.

Like V, Nb is an element that increases the fineness of austenite grains due to the pinning effect of Nb carbides or Nb nitrides in a case where typical hot rolling or heat treatment performed at a high temperature is performed and thus enhances the toughness of the pearlite structure. Moreover, Nb is an element that increases the hardness (strength) of the pearlite structure through precipitation hardening by Nb carbides and Nb nitrides generated during a cooling process after hot rolling, thereby enhancing the wear resistance of the pearlite structure. In addition, Nb is an element that stably generates Nb carbides or Nb nitrides from a low temperature range to a high temperature range in the heat-affected zone that is reheated in a temperature range of equal to or less than the Ac1 point, and is thus effective in preventing the heat-affected zone of the welding joint from softening. However, when the Nb content is less than 0.001%, those effects may not be expected, and the enhancement of the pearlite structure in the toughness or hardness (strength) is not acknowledged. In addition, when the Nb content exceeds 0.050%, the precipitation hardening of the Nb carbides or Nb nitrides excessively occurs, and thus the pearlite structure becomes embrittled, thereby degrading the toughness of the rail. Therefore, the Nb addition is limited to 0.001% to 0.050%.

Co is an element that dissolves as a solid solution into the ferrite in the pearlite structure and further increases the fineness of the ferrite in the pearlite structure, thereby enhancing wear resistance. However, when a Co content is less than 0.01%, refinement of a ferrite in the pearlite structure may not be achieved, and thus the effect of enhancing wear resistance may not be expected. In addition, when the Co content exceeds 1.00%, those effects are saturated, and thus refinement of the ferrite in the pearlite structure according to the addition content may not be achieved. In addition, economic efficiency is reduced due to an increase in costs caused by adding alloys. Therefore, a Co addition is limited to 0.01% to 1.00%.

B is an element that forms iron-borocarbides ($Fe_{23}(CB)_6$) in austenite grain boundaries, accelerates pearlite transformation, and thus reduces the cooling rate dependence of the pearlite transformation temperature. Accordingly, B imparts a more uniform hardness distribution from a head surface to the inside and thus increases the service life of the rail. However, when a B content is less than 0.0001%, those effects are not sufficient, and the improvement of the hardness distribution of the rail head portion is not acknowledged. In addition, when a B content exceeds 0.0050%, coarse iron-borocarbides are generated, and thus brittle fracture is exacerbated, resulting in the degradation of the toughness of the rail. Therefore, a B addition is limited to 0.0001% to 0.0050%.

Cu is an element that dissolves as a solid solution into ferrite in the pearlite structure and enhances the hardness (strength) of the pearlite structure through solid solution strengthening, thereby enhancing the wear resistance of the pearlite structure. However, when a Cu content is less than 0.01%, those effects may not be expected. In addition, when the Cu content exceeds 1.00%, due to a significant increase in hardenability, the martensite structure which is harmful to the toughness of the pearlite structure is generated, resulting in the degradation of the toughness of the rail. Therefore, a Cu content is limited to 0.01% to 1.00%.

Ni is an element that enhances the toughness of the pearlite structure and simultaneously increases the hardness (strength) thereof through solid solution strengthening, thereby enhancing the wear resistance of the pearlite structure. Moreover, Ni is an element that finely precipitates as an intermetallic compound of $Ni_3Ti$ with Ti at the welding heat-affected zone and suppresses softening through precipitation hardening. In addition, Ni is an element that suppresses the embrittlement of grain boundaries of steel having Cu added. However, when the Ni content is less than 0.01%, those effects are significantly small. In addition, when the Ni content exceeds 1.00%, the martensite structure is generated in the pearlite structure due to the significant increase in hardenability, resulting in the degradation of the toughness of the rail. Therefore, the Ni content is limited to 0.01% to 1.00%.

Ti is an element that precipitates as Ti carbides or Ti nitrides in a case where typical hot rolling or heat treatment performed at a high temperature is performed and increases the fineness of austenite grains due to the pinning effect, thereby being effective in enhancing the toughness of the pearlite structure. Moreover, Ti is an element that increases the hardness (strength) of the pearlite structure through precipitation hardening by the Ti carbides and Ti nitrides generated during a cooling process after the hot rolling, thereby enhancing the wear resistance of the pearlite structure. In addition, Ti is a component that increases the fineness of the structure of the heat-affected zone heated to an austenite range by using properties of the Ti carbides and Ti nitrides, which precipitate during reheating for welding, not dissolving, and is thus effective in preventing the embrittlement of the welding joint portion. However, when a Ti content is smaller than 0.0050%, those effects are small. In addition, when a Ti content exceeds 0.0500%, coarse Ti carbides and Ti nitrides are generated, and thus brittle fracture is exacerbated, resulting in the degradation of the toughness of the rail. Therefore, a Ti addition is limited to 0.0050% to 0.0500%.

Mg is an element that is bonded to O, S, Al, or the like and forms fine oxides, suppresses the growth of crystal grains during reheating in rail rolling, and thus increases the fineness of the austenite grains, thereby enhancing the toughness of the pearlite structure. Moreover, Mg contributes to the occurrence of pearlite transformation because MgS causes MnS to be finely distributed and thus nuclei of ferrite or cementite form in the periphery of MnS. As a result, the fineness of the block size of pearlite is increased, thereby enhancing the toughness of the pearlite structure. However, when the Mg content is less than 0.0005%, those effects are weak. When the Mg content exceeds 0.0200%, coarse oxides of Mg are generated, and thus brittle fracture is exacerbated, resulting in the degradation of the toughness of the rail. Therefore, the Mg content is limited to 0.0005% to 0.0200%.

Ca is strongly bonded to S and forms sulfide as CaS. CaS causes MnS to be finely distributed and causes a dilute zone of Mn to form in the periphery of MnS, thereby contributing to the occurrence of pearlite transformation. As a result, the fineness of the block size of pearlite is increased, so that the toughness of the pearlite structure can be enhanced. However, when the Ca content is less than 0.0005%, those effects are weak. When the Ca content exceeds 0.0200%, coarse oxides of Ca are generated, and thus brittle fracture is exacerbated, resulting in the degradation of the toughness of the rail. Therefore, the Ca content is limited to 0.0005% to 0.0200%.

Zr increases the equiaxial crystallization rate of a solidified structure because a $ZrO_2$ inclusion has good lattice matching with γ-Fe and thus the $ZrO_2$ inclusion becomes a solidification nucleus of a high-carbon rail steel which is a γ-phase solidification. As a result, the formation of a segregation zone of the center portion of a slab or bloom is suppressed, thereby suppressing the generation of the martensite or pro-eutectoid cementite structure generated at the rail segregation portion. However, when the Zr content is less than 0.0001%, the number of $ZrO_2$-based inclusions is small, and thus a sufficient action as a solidification nucleus is not exhibited. As a result, a martensite or pro-eutectoid cementite structure is generated at the segregation portion, and thus the toughness of the rail is degraded. In addition, when the Zr content exceeds 0.2000%, a large amount of coarse Zr-based inclusions is generated, and thus brittle fracture is exacerbated, resulting in the degradation of the toughness of the rail. Therefore, the Zr content is limited to 0.0001% to 0.2000%

Al is an effective component as a deoxidizing material. In addition, Al is an element that moves the eutectoid transformation temperature to a higher temperature side and thus contributes to an increase in the hardness (strength) of the pearlite structure, thereby enhancing the wear resistance of the pearlite structure. However, when the Al content is less than 0.0040%, those effects are weak. In addition, when the Al content exceeds 1.00%, it is difficult to cause Al to dissolve as a solid solution in steel, and thus coarse alumina-based inclusions are generated. In addition, the coarse precipitates become the origins of fatigue damage, and thus brittle fracture is exacerbated, resulting in the degradation of the toughness of the rail. Moreover, oxides are generated during welding, so that weldability is significantly degraded. Therefore, an Al addition is limited to 0.0040% to 1.00%.

N segregates at austenite grain boundaries and thus accelerates pearlite transformation from the austenite grain boundaries. In addition, N mainly increases the fineness of the pearlite block size, thereby enhancing toughness. In addition, precipitation of VN or AlN is accelerated by simultaneously adding V and Al. Therefore, in a case where typical hot rolling or heat treatment performed at a high temperature is performed, the fineness of austenite grains are increased due to the pinning effect of VN or AlN, thereby enhancing the toughness of the pearlite structure. However, when the N content is less than 0.0050%, those effects are weak. When the N content exceeds 0.0200%, it is difficult for N to dissolve as a solid solution in steel, bubbles that become the origins of fatigue damage are generated, and thus brittle fracture is exacerbated, resulting in the degradation of the toughness of the rail. Therefore, the N content is limited to 0.0050% to 0.0200%. The rail steel having the component composition described above may be manufactured as ingots in a typical melting furnace such as a converter furnace or an electric furnace, and the melted steel may be manufactured as a rail by ingot casting, and blooming or continuous casting and further by hot rolling.

(2) Reason for Limitation of Metallic Structure

The reason that the metallic structure of a rail head surface portion in the steel rail of the present invention is limited to pearlite will be described in detail.

When the pro-eutectoid ferrite structure, the pro-eutectoid cementite structure, the bainite structure, and the martensite structure are mixed with the pearlite structure, fine brittle cracking occurs in the pro-eutectoid cementite structure and the martensite structure having relatively low toughnesses, resulting in degradation of the toughness of the rail. In addition, when the pro-eutectoid ferrite structure and the bainite structure having relatively low hardnesses are mixed with the pearlite structure, wear is accelerated, resulting in the degradation of the wear resistance of the rail. Therefore, for purposes of enhancing wear resistance and toughness, a pearlite structure is preferable as the metallic structure of the rail head surface portion. Therefore, the metallic structure of the rail head surface portion is limited to the pearlite structure.

In addition, it is preferable that the metallic structure of the rail according to this embodiment be a pearlite single phase structure according to the above limitation. However, depending on the component system of the rail and the heat treatment manufacturing method, a small amount of the pro-eutectoid ferrite structure, the pro-eutectoid cementite structure, the bainite structure, or the martensite structure which has an area ratio of less than 3% is incorporated into the pearlite structure. However, even though such a structure is incorporated, when the area ratio thereof is less than 3%, the structure does not have a significant adverse effect on the wear resistance or toughness of the rail head portion. Therefore, a structure other than the pearlite structure, such as the pro-eutectoid ferrite structure, the pro-eutectoid cementite structure, the bainite structure, or the martensite structure may be mixed with the structure of the steel rail having excellent wear resistance and toughness as long as the area ratio of the structure is less than 3%, that is, the structure is small in amount.

In other words, 97% or higher of the metallic structure of the rail head surface portion according to this embodiment may be the pearlite structure. In order to sufficiently ensure the wear resistance or toughness needed for the rail, it is more preferable that 99% or higher of the metallic structure of the head surface portion be the pearlite structure. In addition, in the Microstructure column in Tables 1-1 to 3-2, a small amount designates less than 3%.

Specifically, the ratio of the metallic structure is the value of an area ratio in a case where a position at a depth of 4 mm from the surface of the rail head surface portion and the position is observed using a microscope. The measurement method is as described below.

Pretreatment: after rail cutting, polishing of a transverse cross-section.

Etching. 3% Nital

Observation machine: optical microscope.

Observation position: a position at a depth of 4 mm from the surface of the rail head surface portion.

Figure 6:
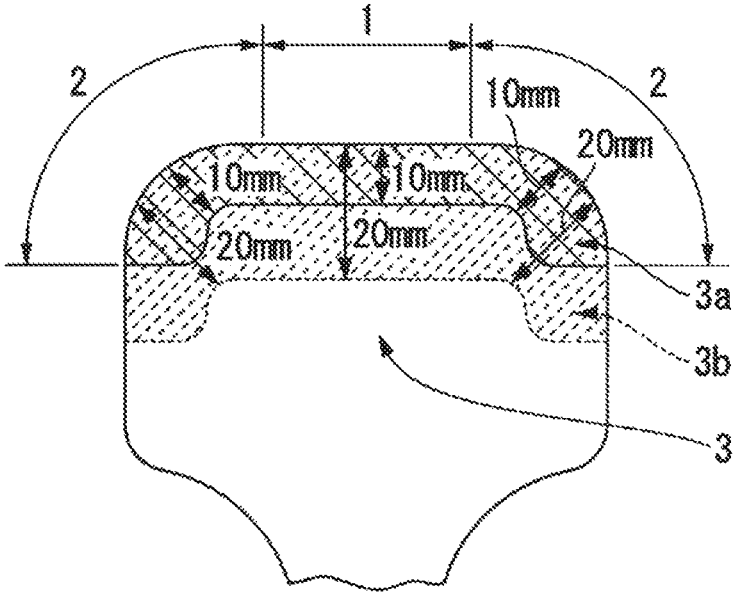
FIG. 6 is an explanatory view of the head portion of a steel rail manufactured by a method of manufacturing a steel rail according to an embodiment of the present invention.

* Specific positions of the rail head surface portion are as indicated in FIG. 6.

Observation count: 10 or more points.

Structure determination method: each structure of pearlite, bainite, martensite, pro-eutectoid ferrite, and pro-eutectoid cementite was determined through taking photographs of the structures and detailed observation.

Ratio calculation: calculation of area ratio through image analysis.

(3) Necessary Range of Pearlite Structure

Next, the reason that the necessary range of the pearlite structure for the rail head portion of the steel rail of the present invention is limited to the head surface portion of the rail steel will be described.

FIG. 6 shows a diagram in a case where the steel rail having excellent wear resistance and toughness according to this embodiment is viewed in a cross-section perpendicular to the longitudinal direction thereof. A rail head portion 3 includes a head top portion 1 and head corner portions 2 positioned at both ends of the head top portion 1. One of the head corner portions 2 is a gauge corner (G.C.) portion that mainly comes into contact with wheels.

A range from the surface of the head corner portions 2 and the head top portion 1 as a starting point to a depth of 10 mm is called a head surface portion (reference numeral 3*a*, solid line portion). In addition, a range from the surface of the head corner portions 2 and the head top portion 1 as the starting point to a depth of 20 mm denoted by reference numeral 3*b* (dotted line portion).

As shown in FIG. 6, when the pearlite structure is disposed in the head surface portion (reference numeral 3*a*) in the range from the surface of the head corner portions 2 and the head top portion 1 as the starting point to a depth of 10 mm, wear due to contact with wheels is suppressed, and thus the enhancement of the wear resistance of the rail is achieved. On the other hand, in a case where the pearlite structure is disposed in a range of less than 10 mm, the suppression of wear due to contact with wheels is not sufficiently achieved, and the service life of the rail is reduced. Therefore, a necessary depth for the pearlite structure is limited to the head surface portion having a depth of 10 mm from the surface of the head corner portions 2 and the head top portion 1 as the starting point.

In addition, it is more preferable that the pearlite structure be disposed in the range 3*b* from the surface of the head corner portions 2 and the head top portion 1 as the starting point to a depth of 20 mm, that is, at least in the dotted line portion in FIG. 6.

Accordingly, wear resistance in a case where the rail head portion is worn down to the inner portion due to contact with wheels may further be enhanced, and thus the enhancement of the service life of the rail is achieved.

It is preferable that the pearlite structure be disposed in the vicinity of the surface of the rail head portion 3 where wheels and the rail mainly come into contact with each other, and in terms of wear resistance, the other portions may have a metallic structure other than the pearlite structure.

(4) Reason for Limitation of Hardness of Pearlite Structure of Head Surface Portion Next, the reason that the hardness of the pearlite structure of the rail head surface portion in the steel rail of this embodiment is limited to a range of Hv320 to 500 will be described.

In this component system, when the hardness of the pearlite structure is less than Hv320, the wear resistance of the rail head surface portion is degraded, resulting in a reduction in the service life of the rail. In addition, when the hardness of the pearlite structure exceeds Hv500, fine brittle cracking is more likely to occur in the pearlite structure, resulting in the degradation of the toughness of the rail. Therefore, the hardness of the pearlite structure is limited to the range of Hv320 to 500.

In addition, as a method of obtaining the pearlite structure having a hardness of Hv320 to 500 in the rail head portion, as described later, accelerated cooling is preferably performed on the rail head portion at 750° C. or higher after hot rolling or after reheating.

Specifically, the hardness of the head portion of the rail of this embodiment is a value obtained when a position at a depth of 4 mm from the surface of the rail head surface portion is measured by a Vickers hardness tester. The measurement method is as described below.

Pretreatment: after rail cutting, polishing of a transverse cross-section.

Measurement method: measurement based on JIS Z 2244.

Measurer: Vickers hardness tester (a load of 98N).

Measurement point: a position at a depth of 4 mm from the surface of the rail head surface portion

* Specific position of the rail head surface portion is as indicated in FIG. 6.

Measure count: it is preferable that 5 or more points be measured and the average value thereof is used as a representative value of the steel rail.

(5) Reason for Limitation of CMn/FMn Value in Pearlite Structure

Next, the reason that the CMn/FMn value in the pearlite structure in the steel rail of the present invention is limited to 5.0 or less will be described.

When the CMn/FMn value in the pearlite structure is reduced, the Mn concentration in the cementite phase is reduced. As a result, the toughness of the cementite phase is enhanced, and thus cracking in the cementite phase at an origin that receives an impact is reduced. As a result of performing a laboratory test in detail, it was confirmed that when the CMn/FMn value was controlled to be equal to or less than 5.0, cracking in the cementite phase at the origin that received an impact was significantly reduced, and thus an impact value was significantly enhanced. Therefore, the CMn/FMn value is limited to 5.0 or less. In addition, in consideration of a range of a heat treatment condition on the premise that the pearlite structure is ensured, it is thought that the limit of the CMn/FMn value is about 1.0 when a rail is actually manufactured.

To measure the Mn concentration of the cementite phase (CMn) and the Mn concentration of the ferrite phase (FMn) in the pearlite structure of the rail of this embodiment, a 3D atom probe (3DAP) method was used. The measurement method is as described below.

Specimen collection position: a position of 4 mm from the surface of the rail head surface portion Pretreatment: a needle specimen is processed according to an FIB (focused ion beam) method (10 μm×10 μm×100 μm)

Measurer: 3D atom probe (3 DAP) method

Measurement method:

Component analysis of metallic ions emitted by voltage application using a coordinate detector Ion flight time: kind of element, Coordinates: 3D position Voltage: DC, Pulse (pulse ratio of 20% or higher)

Specimen Temperature: 40K or less

Measurement count: 5 or more points are measured and the average value thereof is used as a representative value.

(6) Heat Treatment Condition

First, the reason that the temperature of the head portion of the rail at which accelerated cooling is started is limited to 750° C. or higher will be described.

When the temperature of the head portion is less than 750° C., a pearlite structure is generated before accelerated cooling, and controlling the hardness of the head surface portion by heat treatment becomes impossible, and thus a predetermined hardness is not obtained. In addition, in steel with a high carbon content, a pro-eutectoid cementite structure is generated, and thus the pearlite structure becomes embrittled, resulting in the degradation of the toughness of the rail. Therefore, the temperature of the head portion of the steel rail at which accelerated cooling is performed is limited to 750° C. or higher.

Next, in a method of performing accelerated cooling on the rail head portion at a cooling rate of 4 to 15° C./sec from a temperature range of equal to or higher than 750° C. and stopping the accelerated cooling at a time point when the temperature of the head portion of the steel rail reaches 600° C. to 450° C., the reason that the accelerated cooling stop temperature range and the accelerated cooling rate are limited to the above ranges will be described.

When accelerated cooling is stopped at a temperature of higher than 600° C., pearlite transformation is started at a high temperature range immediately after the cooling, and thus a large amount of coarse pearlite structure having a low hardness is generated. As a result, when the hardness of the head surface portion becomes less than Hv320, and thus it is difficult to ensure the necessary wear resistance for the rail. In addition, when accelerated cooling to less than 450° C. is performed, in the component system, an austenite structure is not transformed at all during accelerated cooling, and a bainite structure or a martensite structure is generated in the head surface portion, resulting in the degradation of the wear resistance or toughness of the rail. Therefore, the accelerated cooling stop temperature range is limited to a range of 600° C. to 450° C.

Next, when the accelerated cooling rate of the head portion becomes less than 4° C./sec, pearlite transformation is started during the accelerated cooling in a high temperature range. As a result, the hardness of the head surface portion becomes less than Hv320, and it is difficult to ensure the necessary wear resistance for the rail. In addition, the diffusion of Mn is accelerated during the pearlite transformation, the Mn concentration of the cementite phase is increased, and thus the CMn/FMn value exceeds 5.0. As a result, the occurrence of cementite cracking at a starting point portion is accelerated, and thus the toughness of the rail is degraded. In addition, when the accelerated cooling rate exceeds 15° C./sec, in the component system, a bainite structure or a martensite structure is generated in the head surface portion. In addition, in a case when the accelerated cooling rate is relatively high, high recuperative heat is generated after the accelerated cooling. As a result, the diffusion of Mn is accelerated during transformation, the Mn concentration of the cementite phase is increased, and thus the CMn/FMn value exceeds 5.0. As a result, the wear resistance or toughness of the rail is degraded. Therefore, the cooling rate is limited to a range of 4 to 15° C./sec.

In addition, in order to stably generate a pearlite structure having excellent wear resistance and toughness, it is preferable that the accelerated cooling rate have a range of 5 to 12° C./sec.

Next, the reason that the maximum temperature increase amount including transformation heat and recuperative heat generated after the accelerated cooling is limited to 50° C. or less from the accelerated cooling stop temperature will be described.

In the component system, accelerated cooling is performed on the rail head portion from a temperature range of equal to or higher than 750° C., and when the accelerated cooling is stopped in a range of 600° C. to 450° C., a temperature increase including transformation heat and recuperative heat occurs after the accelerated cooling. The temperature increase amount is significantly changed by a selection of the accelerated cooling rate or the stop temperature, and there may be cases where the temperature of the surface of the rail head portion is increased to about 150° C. at the maximum. The temperature increase amount represents the behavior of the pearlite transformation of the head surface portion as well as the surface of the rail head portion, and has a significant effect on the properties of the pearlite structure of the rail head surface portion, that is, toughness (the Mn content in the cementite phase). When the maximum temperature increase amount including transformation heat and recuperative heat exceeds 50° C., the diffusion of Mn into the cementite phase during pearlite transformation is accelerated due to a temperature increase, the Mn concentration of the cementite phase is increased, and thus the CMn/FMn value exceeds 5.0. As a result, the occurrence of cracking in the cementite phase at a starting point portion is accelerated, and thus the toughness of the rail is degraded. Therefore, the maximum temperature increase amount is limited to 50° C. or less from the accelerated cooling stop temperature. In addition, although the lower limit of the maximum temperature increase amount is not limited, in order to steadily terminate the pearlite transformation and to cause the CMn/FMn value to reliably be equal to or less than 5.0, it is preferable that the lower limit thereof be 0° C.

Next, in a method of performing accelerated cooling at a cooling rate of 0.5 to 2.0° C./sec after the temperature increase including transformation heat and recuperative heat and stopping the accelerated cooling at a time point when the temperature of the head portion of the steel rail reaches 400° C. or less, the reason that the accelerated cooling stop temperature range and the accelerated cooling rate are limited to the above ranges will be described.

When accelerated cooling is stopped at a temperature of higher than 400° C., tempering occurs in the pearlite structure after transformation. As a result, the hardness of the pearlite structure is reduced, and thus the wear resistance of the rail is degraded. Therefore, the accelerated cooling stop temperature is limited to a range of equal to or less than 400° C. In addition, although the lower limit of the accelerated cooling stop temperature is not limited, in order to suppress the tempering of the pearlite structure and suppress the generation of the martensite structure at a segregation portion, it is preferable that the lower limit thereof be 100° C. or higher.

In addition, tempering of a pearlite structure described here designate that the cementite phase of a pearlite structure is in a separated state. When the cementite phase is separated, the hardness of the pearlite structure is reduced, and thus wear resistance is degraded.

Next, when the accelerated cooling rate of the head portion becomes less than 0.5° C./sec, the diffusion of Mn is accelerated, a partial increase in the concentration of Mn in the cementite phase occurs, and thus CMn/FMn value exceeds 5.0. As a result, the occurrence of cracking in the cementite phase at a starting point portion is accelerated, and thus the toughness of the rail is degraded. In addition, when the accelerated cooling rate exceeds 2.0° C./sec, the generation of a martensite structure at a segregation portion is exacerbated, and thus the toughness of the rail is significantly degraded. Therefore, the accelerated cooling rate is limited to a range of 0.5 to 2.0° C./sec. In addition, in terms of suppressing an increase in the concentration of Mn in the cementite phase, it is preferable that the accelerated cooling be performed as immediately as possible after completing the temperature increase in an actual operation.

Temperature control of the rail head portion during a heat treatment may be performed by representatively measuring the temperature of the surface of the head portion at the head top portion (reference numeral 1) and the head corner portion (reference numeral 2) shown in FIG. 6 for the entire rail head surface portion (reference numeral 3*a*).

EXAMPLES

Next, Examples of the present invention will be described.

Figure 8:
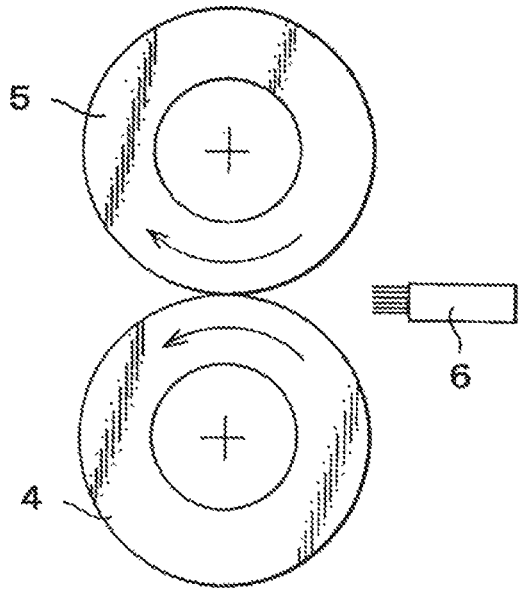
FIG. 8 is a side view showing the summary of the wear tests shown in Tables 1-1 to 3-2
Figure 9:
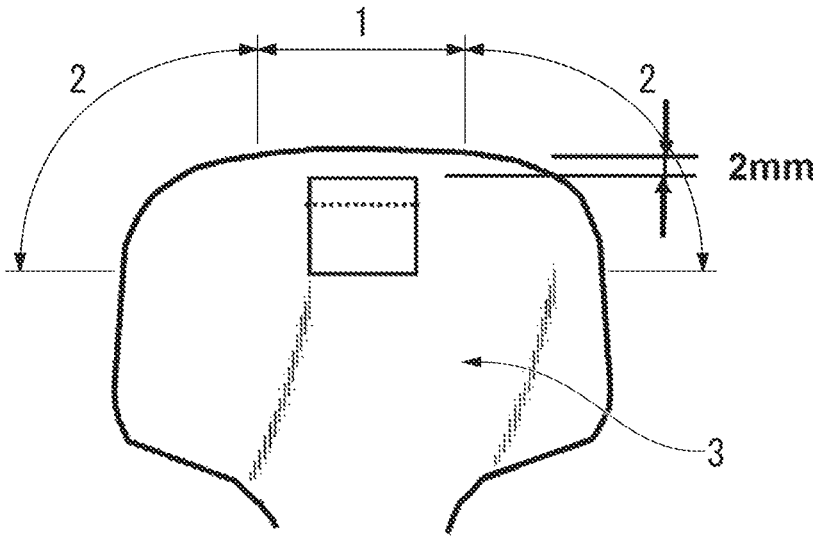
FIG. 9 is a diagram showing the head portion of the steel rail and is an explanatory view showing a specimen collection position in impact tests shown in Tables 1-1 to 3-2.

Tables 1-1 and 1-2 show the chemical components and characteristics of the rail steel of the present invention. Tables 1-1 and 1-2 show chemical component value, the microstructure of the rail head portion, hardness, and CMn/FMn value. Moreover, the results of a wear test performed on a specimen collected from the position shown in FIG. 7 by a method shown in FIG. 8 and the results of an impact test performed on a specimen collected from the position shown in FIG. 9 are also shown.

In addition, the manufacturing conditions of the rail steel of the present invention shown in Tables 1-1 and 1-2 are as described below.

[Cooling Conditions after Hot Rolling and Reheating]

Cooling start temperature: 800° C., cooling rate: 7° C./sec,

Cooling stop temperature: 500° C., maximum temperature increase amount: 30° C.

[Cooling Conditions after Temperature Increase]

Cooling start temperature: 530° C., cooling rate: 1.0° C./sec,

Cooling stop temperature: 350° C.

Table 2 shows the chemical components and characteristics of comparative rail steels. Table 2 shows chemical component value, the microstructure of the rail head portion, hardness, and CMn/FMn value. Moreover, the results of a wear test performed on a specimen collected from the position shown in FIG. 7 by a method shown in FIG. 8 and the results of an impact test performed on a specimen collected from the position shown in FIG. 9 are also shown.

In addition, the manufacturing conditions of the rail steel of the present invention shown in Table 2 are as described below.

[Cooling Conditions after Hot Rolling and Reheating]

Cooling start temperature: 800° C., cooling rate: 7° C./sec,

Cooling stop temperature: 500° C., maximum temperature increase amount: 30° C.

[Cooling Conditions after Temperature Increase]

Cooling start temperature: 530° C., cooling rate: 1.0° C./sec,

Cooling stop temperature: 350° C.

Tables 3-1 and 3-2 show the manufacturing results of the method of manufacturing a rail of the present invention and the manufacturing results of a comparative manufacturing method, using the rail steels shown in Tables 1-1 and 1-2.

Tables 3-1 and 3-2 show, as the cooling conditions after hot rolling and reheating, cooling start temperature, cooling rate, cooling stop temperature, and moreover maximum temperature increase amount after stopping cooling, and show, as the cooling conditions after a temperature increase, cooling start temperature, cooling rate, and cooling stop temperature.

In addition, the microstructure of the rail head portion, hardness, and CMn/FMn value. Moreover, the results of a wear test performed on a specimen collected from the position shown in FIG. 7 by a method shown in FIG. 8 and the results of an impact test performed on a specimen collected from the position shown in FIG. 9 are also shown.

TABLE 1-1

| Rail | Steel | Chemical compound (mass %) | | | | | | | | | | | | | | | | | |
|---|---|---|---|---|---|---|---|---|---|---|---|---|---|---|---|---|---|---|---|
| | | C | Si | Mn | Cr | P | Mo | V | Nb | Co | B | Cu | Ni | Ti | Mg | Ca | Zr | Al | N |
| Rail steel of present invention | A1 | 0.86 | 0.25 | 0.40 | 0.50 | 0.0100 | — | — | — | — | — | — | — | — | — | — | — | — | — |
| | A2 | 1.20 | 0.25 | 0.40 | 0.50 | 0.0100 | — | — | — | — | — | — | — | — | — | — | — | — | — |
| | A3 | 0.90 | 0.05 | 0.30 | 0.45 | 0.0120 | — | — | — | — | — | — | — | — | — | — | — | — | — |
| | A4 | 0.90 | 2.00 | 0.30 | 0.45 | 0.0120 | — | — | — | — | — | — | — | — | — | — | — | — | — |
| | A5 | 1.00 | 0.50 | 0.05 | 0.35 | 0.0060 | — | — | — | — | — | — | — | — | — | — | — | — | — |
| | A6 | 1.00 | 0.50 | 0.50 | 0.35 | 0.0060 | — | — | — | — | — | — | — | — | — | — | — | — | — |
| | A7 | 1.10 | 0.80 | 0.20 | 0.05 | 0.0080 | — | — | — | — | — | — | — | — | — | — | — | — | — |
| | A8 | 1.10 | 0.80 | 0.20 | 0.60 | 0.0080 | — | — | — | — | — | — | — | — | — | — | — | — | — |
| | A9 | 1.00 | 0.60 | 0.50 | 0.20 | 0.0020 | — | — | — | — | — | — | — | — | — | — | — | — | — |
| | A10 | 1.00 | 0.60 | 0.50 | 0.20 | 0.0150 | — | — | — | — | — | — | — | — | — | — | — | — | — |
| | A11 | 0.86 | 0.50 | 0.45 | 0.20 | 0.0100 | — | 0.03 | — | — | — | — | — | — | — | — | — | — | — |
| | A12 | 0.86 | 0.50 | 0.30 | 0.20 | 0.0100 | — | 0.03 | — | — | — | — | — | — | — | — | — | — | — |
| | A13 | 0.86 | 0.50 | 0.20 | 0.20 | 0.0150 | — | 0.03 | — | — | — | — | — | — | — | — | — | — | — |
| | A14 | 0.88 | 0.25 | 0.45 | 0.30 | 0.0150 | 0.02 | — | — | — | — | — | — | — | — | — | — | — | — |
| | A15 | 0.90 | 0.50 | 0.45 | 0.40 | 0.0120 | — | — | — | — | — | — | — | — | — | — | — | — | — |
| | A16 | 0.90 | 0.50 | 0.30 | 0.40 | 0.0120 | — | — | — | — | — | — | — | — | — | — | — | — | — |
| | A17 | 0.90 | 0.50 | 0.15 | 0.40 | 0.0120 | — | — | — | — | — | — | — | — | — | — | — | — | — |
| | A18 | 0.92 | 0.80 | 0.20 | 0.10 | 0.0140 | — | — | 0.005 | — | — | — | — | — | — | — | — | — | — |
| | A19 | 0.93 | 0.20 | 0.35 | 0.45 | 0.0120 | — | — | — | 0.15 | — | — | — | — | — | — | — | — | — |
| | A20 | 0.94 | 0.50 | 0.30 | 0.10 | 0.0120 | — | — | — | — | 0.0025 | — | — | — | — | — | — | — | — |
| | A21 | 0.95 | 0.55 | 0.40 | 0.15 | 0.0140 | — | — | — | — | — | — | — | — | — | — | — | — | — |
| | A22 | 0.95 | 0.55 | 0.30 | 0.15 | 0.0080 | — | — | — | — | — | — | — | — | — | — | — | — | — |
| | A23 | 0.95 | 0.55 | 0.10 | 0.15 | 0.0040 | — | — | — | — | — | — | — | — | — | — | — | — | — |
| | A24 | 0.98 | 0.10 | 0.40 | 0.55 | 0.0130 | — | — | — | — | — | 0.15 | — | — | — | — | — | — | — |
| | A25 | 0.99 | 0.30 | 0.25 | 0.60 | 0.0130 | — | — | — | — | — | — | 0.20 | — | — | — | — | — | — |

| Steel | Head portion material *1 Microstructure | Hardness (Hv, 98N) | CMn/FMn value | Wear test result *2 Wear amount (g, 700000 times) | Impact test result *3 Impact value (J/cm$^2$) |
|---|---|---|---|---|---|
| A1 | Pearlite + Small amount of pro-eutectoid ferrite | 320 | 4.9 | 1.40 | 19.2 |
| A2 | Pearlite + Small amount of pro-eutectoid cementite | 420 | 4.9 | 0.35 | 12.1 |
| A3 | Pearlite | 335 | 4.4 | 1.10 | 18.5 |
| A4 | Pearlite + Small amount of martensite | 490 | 4.4 | 0.82 | 16.5 |
| A5 | Pearlite | 340 | 1.0 | 0.75 | 16.5 |
| A6 | Pearlite | 415 | 5.0 | 0.68 | 15.2 |
| A7 | Pearlite | 350 | 2.1 | | 13.5 |
| A8 | Pearlite + Small amount of bainite | 445 | 2.1 | 0.52 | 13.5 |
| A9 | Pearlite | 430 | 4.9 | 0.61 | 17.2 |
| A10 | Pearlite | 430 | 4.9 | 0.62 | 16.0 |
| A11 | Pearlite + Small amount of pro-eutectoid ferrite | 390 | 4.6 | 1.10 | 18.8 |
| A12 | Pearlite + Small amount of pro-eutectoid ferrite | 385 | 2.8 | 1.12 | 19.5 |
| A13 | Pearlite + Small amount of pro-eutectoid ferrite | 380 | 1.9 | 1.13 | 21.0 |
| A14 | Pearlite + Small amount of bainite | 365 | 4.4 | 0.94 | 18.2 |
| A15 | Pearlite | 450 | 4.5 | 0.81 | 17.5 |
| A16 | Pearlite | 445 | 3.1 | 0.83 | 18.4 |
| A17 | Pearlite | 440 | 1.5 | 0.84 | 20.5 |
| A18 | Pearlite | 355 | 2.0 | 0.97 | 17.5 |
| A19 | Pearlite | 400 | 3.2 | 0.88 | 16.5 |
| A20 | Pearlite | 380 | 3.0 | 0.82 | 16.5 |
| A21 | Pearlite | 405 | 4.1 | 0.74 | 16.5 |
| A22 | Pearlite | 400 | 3.0 | 0.75 | 18.2 |
| A23 | Pearlite | 300 | 1.0 | 0.76 | 19.8 |
| A24 | Pearlite + Small amount of bainite | 420 | 3.9 | 0.69 | 17.8 |
| A25 | Pearlite + Small amount of bainite | 405 | 2.4 | 0.70 | 18.2 |

TABLE 1-2

| Rail | Steel | Chemical compound (mass %) | | | | | | | | | |
|---|---|---|---|---|---|---|---|---|---|---|---|
| | | C | Si | Mn | Cr | P | Mo | V | Nb | Co | B |
| | A26 | 1.00 | 0.55 | 0.45 | 0.25 | 0.0130 | — | — | — | — | — |
| | A27 | 1.00 | 0.55 | 0.30 | 0.25 | 0.0130 | — | — | — | — | — |
| | A28 | 1.00 | 0.55 | 0.30 | 0.25 | 0.0130 | — | — | — | — | — |
| | A29 | 1.02 | 0.70 | 0.30 | 0.30 | 0.0100 | — | — | — | — | — |
| | A30 | 1.02 | 0.70 | 0.20 | 0.30 | 0.0100 | — | — | — | — | 0.0020 |
| | A31 | 1.04 | 1.30 | 0.20 | 0.05 | 0.0100 | — | — | — | — | — |
| | A32 | 1.04 | 1.30 | 0.10 | 0.05 | 0.0100 | — | 0.03 | — | — | — |
| | A33 | 1.05 | 0.35 | 0.10 | 0.30 | 0.0080 | — | — | — | — | — |
| | A34 | 1.05 | 0.35 | 0.45 | 0.30 | 0.0080 | — | — | — | — | — |
| | A35 | 1.05 | 0.35 | 0.30 | 0.30 | 0.0080 | — | — | — | — | — |
| | A36 | 1.07 | 0.80 | 0.10 | 0.20 | 0.0080 | — | — | — | — | — |
| | A37 | 1.07 | 0.65 | 0.15 | 0.30 | 0.0070 | — | — | — | — | — |
| | A38 | 1.08 | 0.65 | 0.30 | 0.20 | 0.0080 | — | — | — | — | — |
| | A39 | 1.10 | 0.65 | 0.40 | 0.20 | 0.0060 | — | — | — | — | — |
| | A40 | 1.10 | 0.65 | 0.25 | 0.15 | 0.0040 | — | — | — | — | — |
| | A41 | 1.11 | 1.00 | 0.10 | 0.25 | 0.0060 | — | — | — | — | — |
| | A42 | 1.14 | 0.60 | 0.25 | 0.25 | 0.0060 | — | — | — | — | — |
| | A43 | 1.14 | 0.60 | 0.35 | 0.25 | 0.0050 | — | — | — | — | — |
| | A44 | 1.14 | 0.60 | 0.35 | 0.30 | 0.0060 | — | 0.03 | — | — | — |
| | A45 | 1.20 | 0.70 | 0.35 | 0.30 | 0.0060 | — | — | — | — | — |
| | A46 | 1.20 | 0.70 | 0.30 | 0.30 | 0.0040 | — | — | — | — | — |
| | A47 | 1.20 | 0.70 | 0.30 | 0.30 | 0.0020 | — | — | — | — | — |

| Rail | Steel | Chemical compound (mass %) | | | | | | | |
|---|---|---|---|---|---|---|---|---|---|
| | | Cu | Ni | Ti | Mg | Ca | Zr | Al | N |
| | A26 | — | — | — | — | — | — | — | — |
| | A27 | — | — | — | — | — | — | — | — |
| | A28 | — | — | — | — | — | — | — | — |
| | A29 | — | — | 0.0080 | — | — | — | — | — |
| | A30 | — | — | 0.0080 | — | — | — | — | — |
| | A31 | — | — | — | 0.0032 | — | — | — | — |
| | A32 | — | — | — | 0.0032 | — | — | — | — |
| | A33 | — | — | — | — | — | — | — | — |
| | A34 | — | — | — | — | — | — | — | — |
| | A35 | — | — | — | — | — | — | — | — |
| | A36 | — | — | — | — | 0.0025 | — | — | — |
| | A37 | — | — | — | — | — | 0.0100 | — | — |
| | A38 | — | — | — | — | — | — | — | — |
| | A39 | — | — | — | — | — | — | — | — |
| | A40 | — | — | — | — | — | — | — | — |
| | A41 | — | — | — | — | — | — | 0.0200 | — |
| | A42 | — | — | — | — | — | — | — | 0.0100 |
| | A43 | — | — | — | — | — | — | 0.0140 | 0.0100 |
| | A44 | — | — | — | — | — | — | — | 0.0100 |
| | A45 | — | — | — | — | — | — | — | — |
| | A46 | — | — | — | — | — | — | — | — |
| | A47 | — | — | — | — | — | — | — | — |

| Steel | Head portion material *1 Microstructure | Hardness (Hv, 98N) | CMn/FMn value | Wear test result *2 Wear amount (g, 700000 times) | Impact test result *3 Impact value (J/cm$^2$) |
|---|---|---|---|---|---|
| A26 | Pearlite | 435 | 4.5 | 0.62 | 16.7 |
| A27 | Pearlite | 430 | 2.9 | 0.63 | 17.5 |
| A28 | Pearlite | 420 | 1.3 | 0.65 | 18.7 |
| A29 | Pearlite | 485 | 1.9 | 0.54 | 15.9 |
| A30 | Pearlite | 485 | 1.9 | 0.55 | 16.8 |
| A31 | Pearlite | 415 | 1.3 | 0.62 | 16.4 |
| A32 | Pearlite | 415 | 1.3 | 0.63 | 17.5 |
| A33 | Pearlite | 435 | 4.4 | 0.56 | 15.5 |
| A34 | Pearlite | 430 | 1.1 | 0.57 | 16.8 |
| A35 | Pearlite | 425 | 1.2 | 0.59 | 18.0 |
| A36 | Pearlite | 425 | 1.6 | 0.59 | 14.9 |
| A37 | Pearlite | 430 | 1.1 | 0.58 | 14.0 |
| A38 | Pearlite | 430 | 4.0 | 0.50 | 13.0 |
| A39 | Pearlite | 435 | 2.4 | 0.52 | 14.2 |
| A40 | Pearlite | 430 | 1.1 | 0.54 | 15.3 |
| A41 | Pearlite + Small amount of pro-eutectoid cementite | 470 | 2.6 | 0.45 | 12.9 |

TABLE 1-2-continued

| | | | | | |
|---|---|---|---|---|---|
| A42 | Pearlite + Small amount of pro-eutectoid cementite | 410 | 3.7 | 0.48 | 12.7 |
| A43 | Pearlite + Small amount of pro-eutectoid cementite | 410 | 3.7 | 0.47 | 13.5 |
| A44 | Pearlite + Small amount of pro-eutectoid cementite | 410 | 3.7 | 0.45 | 13.6 |
| A45 | Pearlite + Small amount of pro-eutectoid cementite | 480 | 4.3 | 0.35 | 12.5 |
| A46 | Pearlite + Small amount of pro-eutectoid cementite | 470 | 2.1 | 0.36 | 14.0 |
| A47 | Pearlite + Small amount of pro-eutectoid cementite | 465 | 1.0 | 0.38 | 15.0 |

Note 1:

The balance is composed of inevitable impurities and Fe.

*1: Microstructure and hardness are data at a position of 4 mm under the surface of the rail head surface portion.

*2: The wear test was performed on a specimen collected from a position shown in FIG. 7 by a method shown in FIG. 8. The experimental conditions are as described in the specification.

*3: Impact test was performed on a specimen collected from a position shown in FIG. 9. The experimental conditions are as described in the specification.

TABLE 2

| | | Chemical compound (mass %) | | | | | | | | | | | | | | | | | |
|---|---|---|---|---|---|---|---|---|---|---|---|---|---|---|---|---|---|---|---|
| Rail | Steel | C | Si | Mn | Cr | P | Mo | V | Nb | Co | B | Cu | Ni | Ti | Mg | Ca | Zr | Al | N |
| Comparative rail steel | a1 | 0.70 | 0.25 | 0.40 | 0.50 | 0.0100 | — | — | — | — | — | — | — | — | — | — | — | — | — |
| | a2 | 1.30 | 0.25 | 0.40 | 0.50 | 0.0100 | — | — | — | — | — | — | — | — | — | — | — | — | — |
| | a3 | 0.90 | 0.02 | 0.30 | 0.45 | 0.0120 | — | — | — | — | — | — | — | — | — | — | — | — | — |
| | a4 | 0.90 | 2.24 | 0.30 | 0.45 | 0.0120 | — | — | — | — | — | — | — | — | — | — | — | — | — |
| | a5 | 1.00 | 0.50 | 0.03 | 0.35 | 0.0060 | — | — | — | — | — | — | — | — | — | — | — | — | — |
| | a6 | 1.00 | 0.50 | 0.65 | 0.35 | 0.0060 | — | — | — | — | — | — | — | — | — | — | — | — | — |
| | a7 | 1.10 | 0.80 | 0.20 | 0.02 | 0.0080 | — | — | — | — | — | — | — | — | — | — | — | — | — |
| | a8 | 1.10 | 0.80 | 0.20 | 0.75 | 0.0080 | — | — | — | — | — | — | — | — | — | — | — | — | — |
| | a9 | 1.00 | 0.60 | 0.50 | 0.20 | 0.0250 | — | — | — | — | — | — | — | — | — | — | — | — | — |
| | a10 | 1.10 | 0.65 | 0.80 | 0.20 | 0.0060 | — | — | — | — | — | — | — | — | — | — | — | — | — |
| | a11 | 1.20 | 0.70 | 0.70 | 0.30 | 0.0040 | — | — | — | — | — | — | — | — | — | — | — | — | — |
| | a12 | 1.20 | 0.70 | 0.20 | 1.10 | 0.0040 | — | — | — | — | — | — | — | — | — | — | — | — | — |

| Steel | Head portion material *1 Microstructure | Hardness (Hv, 98N) | CMn/FMn value | Wear test result *2 Wear amount (g, 700000 times) | Impact test result *3 Impact value ($J/cm^2$) |
|---|---|---|---|---|---|
| a1 | Pearlite + Pro-eutectoid ferrite | 300 | 4.9 | 1.87 (large wear) | 21.2 |
| a2 | Pearlite + Pro-eutectoid cementite | 415 | 4.9 | 0.45 | 7.8 (impact value reduction) |
| a3 | Pearlite | 295 | 4.4 | 1.95 (large wear) | 19.5 |
| a4 | Pearlite + Martensite | 525 | 4.4 | 1.68 (large wear) | 5.6 (impact value reduction) |
| a5 | Pearlite | 315 | 1.0 | 1.85 (large wear) | 17.0 |
| a6 | Pearlite | 430 | 6.4 | 0.65 | 6.5 (impact value reduction) |
| a7 | Pearlite | 318 | 2.1 | 1.80 (large wear) | 16.8 |
| a8 | Pearlite + Bainite | 375 | 2.1 | 1.60 (large wear) | 15.6 |
| a9 | Pearlite | 435 | 4.9 | 0.61 | 8.9 (impact value reduction) |
| a10 | Pearlite | 440 | 6.5 | 0.50 | 7.5 (impact value reduction) |

TABLE 2-continued

| | | | | | |
|---|---|---|---|---|---|
| a11 | Pearlite + pro-eutectoid cementite | 480 | 6.2 | 0.32 | 7.1 (impact value reduction) |
| a12 | Pearlite + Martensite | 550 | 2.1 | 1.75 (large wear) | 5.0 (impact value reduction) |

Note 1:

The balance is composed of inevitable impurities and Fe.

*1: Microstructure and hardness are data at a position of 4 mm under the surface of the rail head surface portion.

*2: The wear test was performed on a specimen collected from a position shown in FIG. 7 by a method shown in FIG. 8. The experimental conditions are as described in the specification

*3: Impact test was performed on a specimen collected from a position shown in FIG. 9. The experimental conditions are as described in the specification.

TABLE 3-1

| | | | Cooling conditions after hot rolling reheating | | | | Cooling conditions after temperature increase | | |
|---|---|---|---|---|---|---|---|---|---|
| Rail | Manufacturing No. | Steel | Cooling start temperature (° C.) | Cooling rate (° C./sec) | Cooling stop temperature (° C.) | Maximum temperature increase (° C.) | Cooling start temperature (° C.) | Cooling rate (° C./sec) | Cooling stop temperature (° C.) |
| Manufacturing method of present invention | B1 | A12 | 750 | 4.0 | 500 | 30 | 520 | 1.0 | 350 |
| | B2 | A12 | 750 | 5.0 | 500 | 30 | 520 | 1.0 | 350 |
| | B3 | A12 | 750 | 7.0 | 500 | 30 | 520 | 1.0 | 350 |
| | B4 | A12 | 750 | 12.0 | 500 | 30 | 520 | 1.0 | 350 |
| | B5 | A12 | 750 | 15.0 | 500 | 30 | 520 | 1.0 | 350 |
| | B6 | A12 | 750 | 7.0 | 600 | 30 | 630 | 1.0 | 350 |
| | B7 | A16 | 770 | 7.0 | 500 | 30 | 530 | 1.0 | 350 |
| | B8 | A16 | 770 | 7.0 | 450 | 30 | 470 | 1.0 | 350 |
| | B9 | A16 | 770 | 7.0 | 500 | 50 | 540 | 1.0 | 356 |
| | B10 | A22 | 780 | 7.0 | 500 | 30 | 520 | 1.0 | 350 |
| | B11 | A22 | 780 | 7.0 | 500 | 1 | 500 | 1.0 | 350 |
| | B12 | A22 | 780 | 7.0 | 500 | 30 | 520 | 0.5 | 350 |
| | B13 | A27 | 780 | 7.0 | 500 | 50 | 520 | 1.0 | 350 |
| | B14 | A27 | 780 | 7.0 | 500 | 30 | 520 | 2.0 | 350 |
| | B15 | A27 | 800 | 7.0 | 500 | 30 | 510 | 1.0 | 400 |
| | B16 | A34 | 800 | 7.0 | 500 | 30 | 510 | 1.0 | 350 |
| | B17 | A34 | 800 | 7.0 | 500 | 30 | 510 | 1.0 | 300 |
| | B18 | A34 | 800 | 4.0 | 500 | 30 | 520 | 1.0 | 350 |
| | B19 | A39 | 800 | 5.0 | 500 | 30 | 520 | 1.0 | 350 |
| | B20 | A39 | 800 | 7.0 | 500 | 30 | 520 | 1.0 | 350 |
| | B21 | A39 | 800 | 12.0 | 500 | 30 | 520 | 1.0 | 350 |
| | B22 | A39 | 800 | 15.0 | 500 | 30 | 520 | 1.0 | 350 |
| | B23 | A46 | 820 | 7.0 | 500 | 50 | 515 | 1.0 | 350 |
| | B24 | A46 | 820 | 7.0 | 500 | 30 | 515 | 1.0 | 350 |
| | B25 | A46 | 820 | 7.0 | 500 | 1 | 501 | 1.0 | 350 |

| Manufacturing No. | Head portion material *1 Microstructure | Hardness (Hv, 98N) | CMn/FMn value | Wear test result *2 Wear amount (g, 700000 times) | Impact result *3 Impact value (J/cm$^2$) |
|---|---|---|---|---|---|
| B1 | Pearlite + Small amount of pro-eutectoid ferrite | 360 | 3.7 | 1.26 | 18.4 |
| B2 | Pearlite + Small amount of pro-eutectoid ferrite | 385 | 3.0 | 1.12 | 19.2 |
| B3 | Pearlite + Small amount of pro-eutectoid ferrite | 385 | 2.8 | 1.12 | 19.5 |
| B4 | Pearlite + Small amount of pro-eutectoid ferrite | 425 | 2.1 | 1.02 | 20.5 |
| B5 | Pearlite + Small amount of pro-eutectoid ferrite + Small amount of bainite | 425 | 2.0 | 1.10 | 21.0 |
| B6 | Pearlite | 400 | 3.2 | 0.89 | 18.2 |
| B7 | Pearlite | 445 | 3.1 | 0.83 | 18.4 |
| B8 | Pearlite | 470 | 3.0 | 0.75 | 18.9 |
| B9 | Pearlite | 390 | 3.8 | 0.77 | 17.5 |
| B10 | Pearlite | 400 | 3.0 | 0.75 | 18.2 |
| B11 | Pearlite | 425 | 2.0 | 0.71 | 19.5 |
| B12 | Pearlite | 420 | 3.4 | 0.64 | 16.8 |
| B13 | Pearlite | 430 | 2.9 | 0.63 | 17.5 |
| B14 | Pearlite | 435 | 2.1 | 0.60 | 18.8 |
| B15 | Pearlite | 420 | 3.1 | 0.58 | 17.0 |
| B16 | Pearlite | 430 | 3.1 | 0.57 | 16.8 |
| B17 | Pearlite | 435 | 3.1 | 0.56 | 16.5 |
| B18 | Pearlite | 420 | 3.2 | 0.49 | 13.5 |

TABLE 3-1-continued

| | | | | | |
|---|---|---|---|---|---|
| B19 | Pearlite | 435 | 2.5 | 0.52 | 14.0 |
| B20 | Pearlite | 435 | 2.4 | 0.52 | 14.2 |
| B21 | Pearlite | 435 | 1.3 | 0.52 | 15.4 |
| B22 | Pearlite + Small amount of martensite | 460 | 1.2 | 0.52 | 15.8 |
| B23 | Pearlite + Small amount of pro-eutectoid cementite | 460 | 2.3 | 0.34 | 13.5 |
| B24 | Pearlite + Small amount of pro-eutectoid cementite | 470 | 2.1 | 0.36 | 14.0 |
| B25 | Pearlite + Small amount of pro-eutectoid cementite | 490 | 1.5 | 0.32 | 15.5 |

Note 1:

The balance is composed of inevitable impurities and Fe.

*1: Microstructure and hardness are data at a position of 4 mm under the surface of the rail head surface portion.

*2: The wear test was performed on a specimen collected from a position shown in FIG. 7 by a method shown in FIG. 8. The experimental conditions are as described in the specification.

*3: Impact test was performed on a specimen collected from a position shown in FIG. 9. The experimental conditions are as described in the specification.

TABLE 3-2

| | | | Cooling conditions after hot rolling reheating | | | | Cooling conditions after temperature increase | | |
|---|---|---|---|---|---|---|---|---|---|
| Rail | Manufacturing No. | Steel | Cooling start temperature (° C.) | Cooling rate (° C./sec) | Cooling stop temperature (° C.) | Maximum temperature increase (° C.) | Cooling start temperature (° C.) | Cooling rate (° C./sec) | Cooling stop temperature (° C.) |
| Comparative manufacturing method | b1 | A12 | 680 | 7.0 | 500 | 30 | 520 | 1.0 | 350 |
| | b2 | A46 | 720 | 7.0 | 500 | 30 | 515 | 1.0 | 350 |
| | b3 | A12 | 750 | 3.0 | 500 | 30 | 520 | 1.0 | 350 |
| | b4 | A39 | 800 | 2.0 | 500 | 30 | 520 | 1.0 | 350 |
| | b5 | A11 | 750 | 16.0 | 500 | 30 | 520 | 1.0 | 350 |
| | b6 | A39 | 800 | 17.0 | 500 | 30 | 520 | 1.0 | 350 |
| | b7 | A16 | 770 | 7.0 | 440 | 30 | 460 | 1.0 | 350 |
| | b8 | A16 | 770 | 7.0 | 650 | 30 | 680 | 1.0 | 350 |
| | b9 | A22 | 780 | 18.0 | 600 | 80 | 670 | 1.0 | 350 |
| | b10 | A46 | 820 | 16.0 | 590 | 70 | 650 | 1.0 | 350 |
| | b11 | A27 | 780 | 7.0 | 500 | 30 | 520 | 0.3 | 350 |
| | b12 | A27 | 780 | 7.0 | 500 | 30 | 520 | 3.0 | 350 |
| | b13 | A34 | 800 | 7.0 | 500 | 30 | 510 | 1.0 | 450 |

| Manufacturing No. | Head portion material *1 Microstructure | Hardness (Hv, 98N) | CMn/FMn value | Wear test result *2 Wear amount (g, 700000 times) | Impact result *3 Impact value (J/cm$^2$) |
|---|---|---|---|---|---|
| b1 | Pearlite + Small amount of pro-eutectoid ferrite | 310 | 2.8 | 1.78 (large wear) | 20.0 |
| b2 | Pearlite + pro-eutectoid cementite | 420 | 2.1 | 0.41 | 7.5 (impact value reduction) |
| b3 | Pearlite + Small amount of pro-eutectoid ferrite | 315 | 5.2 | 1.76 (large wear) | 12.0 (impact value reduction) |
| b4 | Pearlite + Pro-eutectoid cementite | 360 | 5.5 | 0.65 | 8.5 (impact value reduction) |
| b5 | Pearlite + Martensite + Bainite | 542 | 2.2 | 1.75 (large wear) | 6.0 (impact value reduction) |
| b6 | Pearlite + Martensite | 524 | 1.0 | 1.61 (large wear) | 6.5 (impact value reduction) |
| b7 | Pearlite + Bainite | 400 | 2.9 | 1.55 (large wear) | 18.9 |
| b8 | Pearlite | 315 | 3.5 | 1.62 (large wear) | 19.0 |
| b9 | Pearlite | 360 | 5.3 | 0.82 | 11.5 (impact value reduction) |
| b10 | Pearlite + Small amount of pro-eutectoid cementite | 420 | 5.2 | 0.45 | 8.5 (impact value reduction) |
| b11 | Pearlite | 420 | 5.3 | 0.64 | 11.0 (impact value reduction) |
| b12 | Pearlite + Martensite | 510 | 2.0 | 1.55 (large wear) | 7.2 (impact value reduction) |
| b13 | Tempered martensite | 310 | 3.1 | 1.78 (large wear) | 18.0 |

In addition, various test conditions are as described below.

[1] Head Portion Wear Test

Tester: Nishihara-type wear testing machine (see FIG. 8)

Specimen shape: disk-shaped specimen (outside diameter: 30 mm, thickness: 8 mm)

Figure 7:
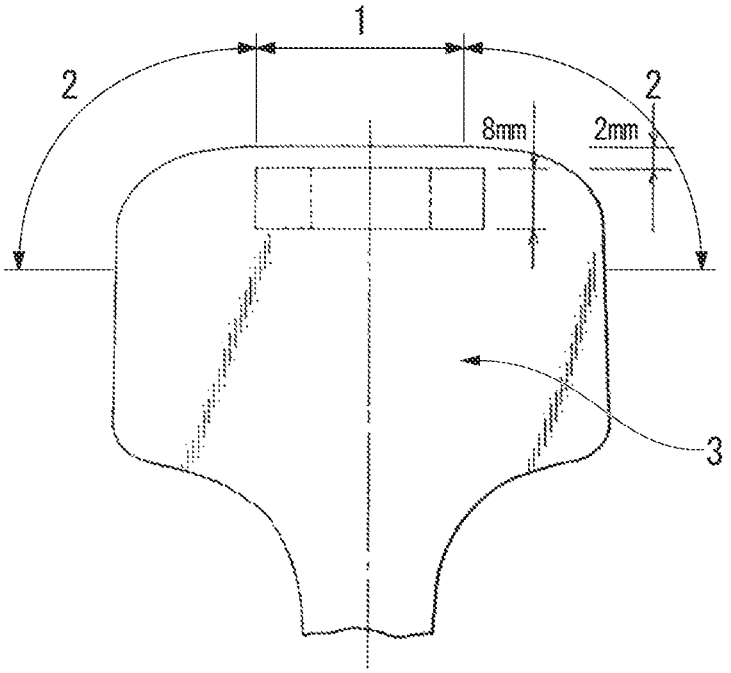
FIG. 7 is a diagram showing the head portion of the steel rail and is an explanatory view showing a specimen collection position in wear tests shown in Tables 1-1 to 3-2.

Specimen collection position: 2 mm under the surface of the rail head portion (see FIG. 7)

Test load: 686 N (contact surface pressure 640 MPa)

Slip ratio: 20%

Wheel specimen (Opposite material): pearlite steel (Vickers hardness: Hv380)

Atmosphere: in the air

Cooling: forced cooling by compressed air (flow rate: 100 L/min)

Number of cycle: 700,000 revolution

In addition, the flow rate of the compressed air is a flow rate converted into a volume at room temperature (20° C.) and at the atmospheric pressure (101.3 kPa).

[2] Head Portion Impact Test

Tester: impact tester

Test method: performed on the basis of JIS Z 2242

Specimen shape: JIS3 type 2 mm U notch

Specimen collection position: 2 mm under the surface of the rail head portion (see FIG. 9, 4 mm under the notch position)

Test temperature: room temperature (20° C.)

In addition, the conditions of each of the rails are as follows.

(1) Rails of the Present Invention (47 Rails)

Reference numerals A1 to A47: rails of which the chemical component values, the microstructures of the rail head portions, hardnesses, and CMn/FMn values are in the ranges of the present invention.

(2) Comparative Rails (12 rails)

Reference numerals a1 to a12: rails of which the chemical component values, the microstructures of the rail head portions, hardnesses, or CMn/FMn values are out of the ranges of the present invention.

(3) Rails manufactured by the manufacturing method of the present invention (25 rails)

Reference numerals B1 to B25: rails of which the cooling start temperatures after hot rolling and reheating, the cooling rates, the cooling stop temperatures, the maximum temperature increase amounts, the cooling rates after a temperature increase, and the cooling stop temperatures are in the ranges of the present invention.

(4) Rails Manufactured by the Comparative Manufacturing Method (13 Rails)

Reference numerals b1 to b13: rails of which any of the cooling start temperatures after hot rolling and reheating, the cooling rates, the cooling stop temperatures, the maximum temperature increase amounts, the cooling rates after a temperature increase, or the cooling stop temperatures is out of the ranges of the present invention.

As shown in Tables 1-1, 1-2, and 2, in the rail steels of the present invention (reference numerals A1 to A47), compared to the comparative rail steels (reference numerals a1 to a12), by causing the chemical components C, Si, Mn, Cr, and P of the steel to be in the limited ranges, the generation of a pro-eutectoid ferrite structure, a pro-eutectoid cementite structure, a bainite structure, and a martensite structure that has an adverse effect on wear resistance or toughness is suppressed, and thus a pearlite structure having a hardness in an optimal range is obtained. In addition, by causing the CMn/FMn value to be equal to or less than a constant value, the wear resistance or toughness of the rail is enhanced.

Figure 10:
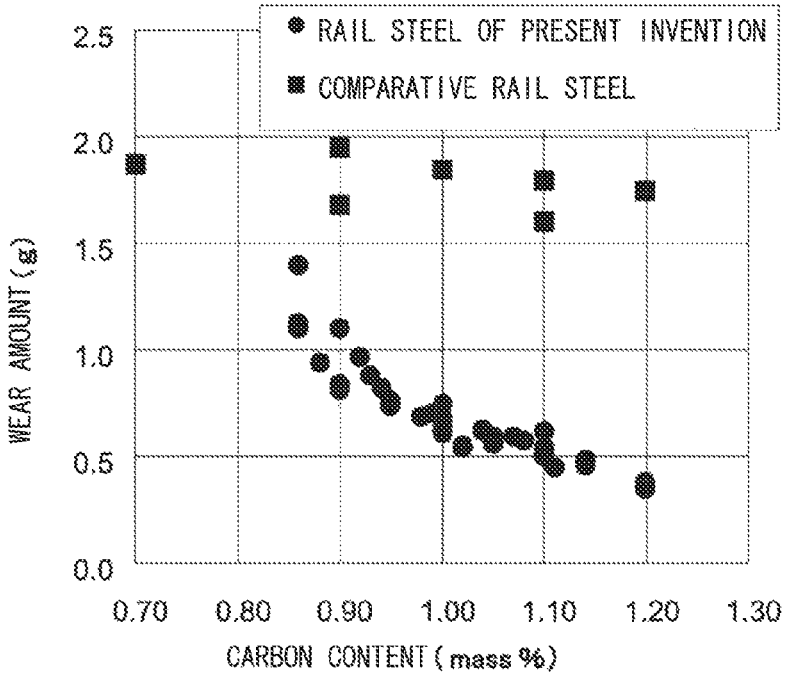
FIG. 10 is a graph showing the relationship between carbon content and wear amount of rail steels (reference numerals A1 to A47) of the present invention and comparative rail steels (reference numerals a1, a3, a4, a5, a7, a8, and a12) shown in Tables 1-1 to 2.
Figure 11:
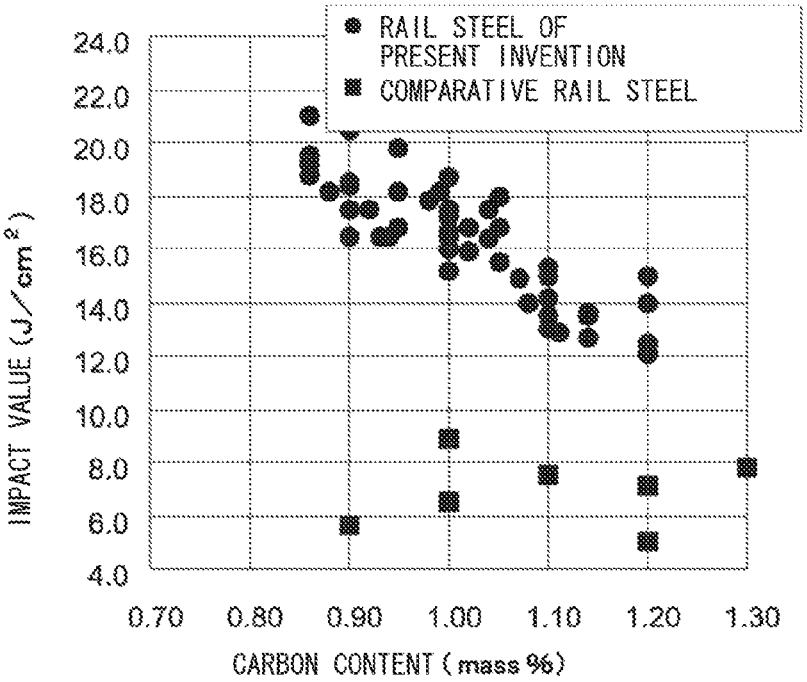
FIG. 11 is a graph showing the relationship between carbon content and impact value of the rail steels (reference numerals A1 to A47) of the present invention and comparative rail steels (reference numerals a2, a4, a6, and a9 to a12) shown in Tables 1-1 to 2.

FIG. 10 shows the relationship between carbon content and wear amount of the rail steels of the present invention (reference numerals A1 to A47) and the comparative rail steels (reference numerals a1, a3, a4, a5, a7, a8, and a12). FIG. 11 shows the relationship between carbon content and impact value of the rail steels of the present invention (reference numerals A1 to A47) and the comparative rail steels (reference numerals a2, a4, a6, and a9 to a12).

As shown in FIGS. 10 and 11, in the rail steels of the present invention (reference numerals A1 to A47), compared to the comparative rail steels (reference numerals a1 to a12), wear amounts are small and impact values are enhanced when the carbon contents are the same. That is, at any carbon content, the wear resistance or toughness of the rail is enhanced.

In addition, as shown in Tables 3-1 and 3-2, in the rail steels manufactured by the manufacturing method of the present invention (reference numerals B1 to B25), compared to the steels manufactured by the comparative manufacturing method (reference numerals b1 to b13), by causing the cooling start temperatures after hot rolling and reheating, cooling rates, cooling stop temperatures, and maximum temperature increase amounts after stopping cooling, cooling rates after a temperature increase, and cooling stop temperatures to be in the limited ranges, the tempering of a pro-eutectoid cementite structure, a bainite structure, a martensite structure, and a pearlite structure that has an adverse effect on wear resistance or toughness is suppressed, and thus a pearlite structure having a hardness in an optimal range is obtained. In addition, by causing the CMn/FMn values to be equal to or less than a constant value, the wear resistance or toughness of the rail is enhanced.

Figure 12:
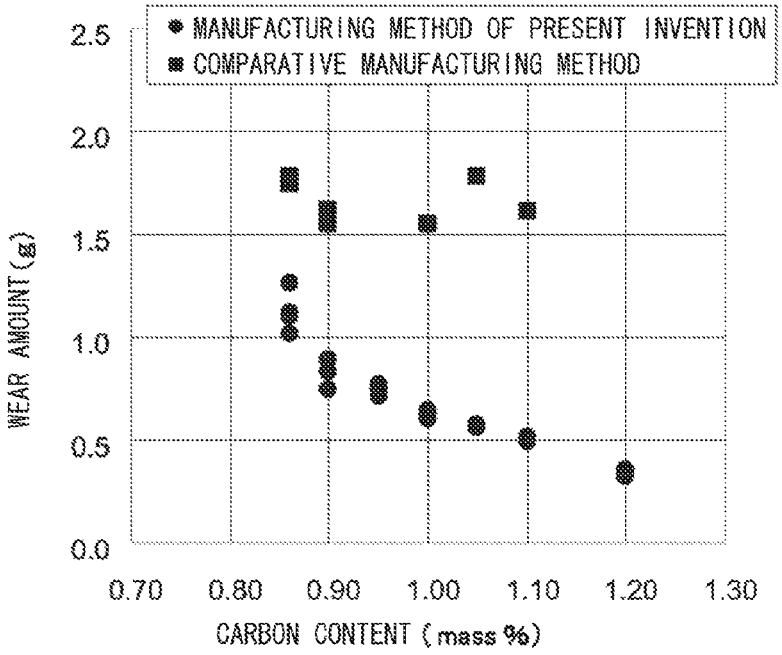
FIG. 12 is a graph showing the relationship between carbon content and wear amount of rail steels (reference numerals B1 to B25) manufactured by the method of manufacturing a steel rail according to the embodiment and rail steels (reference numerals b1, b3, b5 to b8, b12, and b13) manufactured by a comparative manufacturing method, shown in Tables 3-1 and 3-2.
Figure 13:
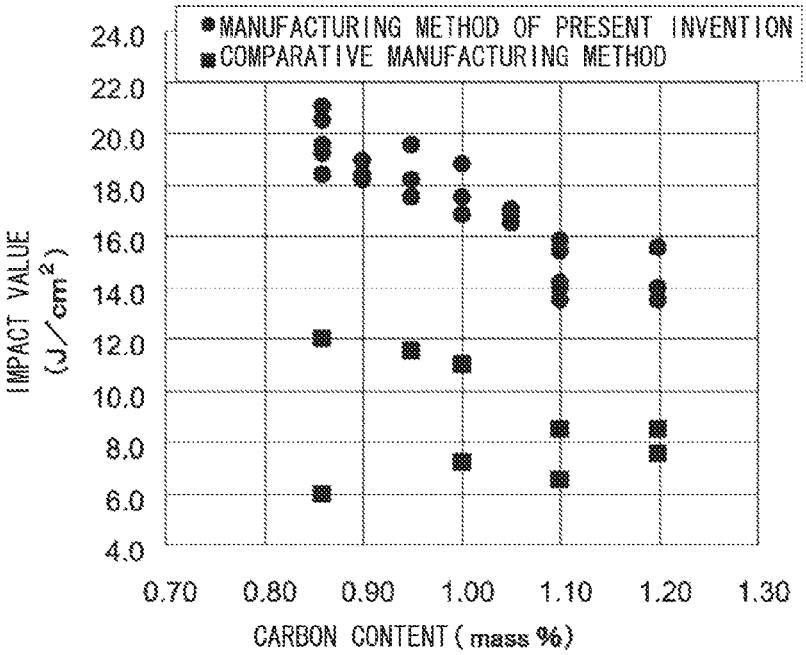
FIG. 13 is a graph showing the relationship between carbon content and impact value of the rail steels (reference numerals B1 to B25) manufactured by the method of manufacturing a steel rail according to the embodiment and rail steels (reference numerals b2 to b6 and b9 to b12) manufactured by the comparative manufacturing method, shown in Tables 3-1 and 3-2.

FIG. 12 shows the relationship between carbon content and wear amount of the rail steels manufactured by the manufacturing method of the present invention (reference numerals B1 to B25) and the rail steels manufactured by the comparative manufacturing method (reference numerals b1, b3, b5 to b8, b12, and b13). FIG. 13 shows the relationship between carbon content and impact value of the rail steels manufactured by the manufacturing method of the present invention (reference numerals B1 to B25) and the rail steels manufactured by the comparative manufacturing method (reference numerals b2 to b6 and b9 to b12).

As shown in FIGS. 12 and 13, in the rail steels manufactured by the manufacturing method of the present invention (reference numerals B1 to B25), compared to the rail steels manufactured by the comparative manufacturing method (reference numerals b1 to b13), wear amounts are small and impact values are enhanced when the carbon contents are the same. That is, at any carbon content, the wear resistance or toughness of the rail is enhanced.

REFERENCE SIGNS LIST

1: head top portion
2: head corner portion
3: rail head portion
3*a*: head surface portion (range from surface of head corner portion and head top portion as starting point to depth of 10 mm)
3*b*: range from surface of head corner portion and head top portion as starting point to depth of 20 mm)
4: rail specimen
5: Wheel specimen (opposite material)
6: cooling nozzle

The invention claimed is:

1. A steel rail comprising:

by mass %, higher than 0.85% to 1.20% of C;

0.05% to 2.00% of Si;

0.05% to 0.50% of Mn;

0.05% to 0.60% of Cr;

P≤0.0150%; and the balance consisting of Fe and inevitable impurities, wherein 97% or more of a head surface portion which is in a range from a surface of a head corner portion and a head top portion as a starting point to a depth of 10 mm has a pearlite structure, a Vickers hardness of the pearlite structure is Hv320 to 500, and a CMn/FMn value which is a value obtained by dividing CMn [at. %] that is a Mn concentration of a cementite phase in the pearlite structure by FMn [at. %] that is a Mn concentration of a ferrite phase is equal to or higher than 1.0 and equal to or less than 5.0.

2. The steel rail according to claim 1, further comprising one kind or two or more kinds selected from the group:

by mass %, 0.01% to 0.50% of Mo;

0.005% to 0.50% of V;

0.001% to 0.050% of Nb;

0.01% to 1.00% of Co;

0.0001% to 0.0050% of B;

0.01% to 1.00% of Cu;

0.01% to 1.00% of Ni;

0.0050% to 0.0500% of Ti;

0.0005% to 0.0200% of Mg;

0.0005% to 0.0200% of Ca;

0.0001% to 0.2000% of Zr;

0.0040% to 1.00% of Al; and 0.0050% to 0.0200% of N.

3. A method of manufacturing the steel rail according to claim 1 or 2, comprising:

performing first accelerated cooling on a head portion of the steel rail at a temperature of equal to or higher than an Ar1 point immediately after hot rolling, or a head portion of the steel rail reheated to a temperature of equal to or higher than the Ac1 point+30° C. for purposes of a heat treatment, at a cooling rate of 4 to 15° C./sec from a temperature range of equal to or higher than 750° C.;

stopping the first accelerated cooling at a time point when a temperature of the head portion of the steel rail reaches 600° C. to 450° C.;

controlling a maximum temperature increase amount including transformation heat and recuperative heat to be equal to or less than 50° C. from an accelerated cooling stop temperature;

thereafter performing second accelerated cooling at a cooling rate of 0.5 to 2.0° C./sec; and stopping the second accelerated cooling at a time point when the temperature of the head portion of the steel rail reaches 400° C. or less.

* * * * *